US011813516B2

(12) United States Patent
Keegan

(10) Patent No.: US 11,813,516 B2
(45) Date of Patent: Nov. 14, 2023

(54) APPARATUS FOR TRANSPORT, STORAGE AND LIFTING OF SPORTING EQUIPMENT

(71) Applicant: Charles H Keegan, Milton, MA (US)

(72) Inventor: Charles H Keegan, Milton, MA (US)

( * ) Notice: Subject to any disclaimer, the term of this patent is extended or adjusted under 35 U.S.C. 154(b) by 0 days.

(21) Appl. No.: 17/667,954

(22) Filed: Feb. 9, 2022

(65) Prior Publication Data

US 2022/0258030 A1 Aug. 18, 2022

Related U.S. Application Data

(60) Provisional application No. 63/203,277, filed on Jul. 15, 2021, provisional application No. 63/200,089, filed on Feb. 12, 2021.

(51) Int. Cl.
*A63C 11/02* (2006.01)

(52) U.S. Cl.
CPC ..... *A63C 11/026* (2013.01)

(58) Field of Classification Search
CPC ..... B62B 1/262; A63C 11/026
See application file for complete search history.

(56) References Cited

U.S. PATENT DOCUMENTS 2,578,409 A * 12/1951 Evans ..... B62B 1/262 280/DIG. 6
2,722,431 A * 11/1955 Victor ..... B62B 1/262 280/DIG. 6
2,957,700 A * 10/1960 Beaurline ..... B62B 1/262 280/DIG. 6
4,114,915 A * 9/1978 Lello ..... A63C 11/00 280/8
5,476,202 A * 12/1995 Lipp ..... B60R 9/12 224/570
5,527,146 A * 6/1996 Allsop ..... B60R 9/12 414/462
5,749,251 A * 5/1998 Keefe ..... A63C 11/007 70/30
6,164,896 A * 12/2000 Cummins ..... B65F 1/1468 224/521
6,685,214 B2 * 2/2004 Gregory ..... A63C 11/026 280/47.29
7,108,140 B2 * 9/2006 Whitnall ..... B60R 9/10 211/195
8,282,119 B1 * 10/2012 Caksa ..... B62B 7/008 280/647
8,646,805 B2 * 2/2014 Goldszer ..... B62B 1/12 280/30
9,545,939 B1 * 1/2017 Wight ..... B62B 7/086
9,586,128 B2 * 3/2017 Condoianis ..... B62B 1/262
11,325,631 B2 * 5/2022 Singh ..... B62B 9/087
2004/0090047 A1 * 5/2004 Kang ..... A63B 55/60 280/652
2010/0181737 A1 * 7/2010 Reinicke ..... B62B 1/262 280/47.19

FOREIGN PATENT DOCUMENTS

CN 102009705 A * 4/2011
DE 102019130939 B3 * 11/2020 ..... A63B 55/10
WO WO-2018068113 A1 * 4/2018 ..... B62B 1/10

* cited by examiner

*Primary Examiner* — James A Shriver, II
*Assistant Examiner* — Michael T. Walsh

(57) ABSTRACT

An apparatus for transport, storage and lifting of sporting equipment such as skis has a wheeled caddy and devices for mounting to a vehicle and to a wall.

13 Claims, 24 Drawing Sheets

100

101

100

100

200

200

200

200

300

300

300

APPARATUS FOR TRANSPORT, STORAGE AND LIFTING OF SPORTING EQUIPMENT

TECHNICAL FIELD

The present disclosure relates to a wheeled caddy for transport and storage of sporting equipment such as skis. Classifications might include A63C11/026—Carrying-devices for skis or ski-sticks on wheels and B62B1/262—Hand carts having only one axis carrying one or more transport wheels; Equipment therefor characterized by supports specially adapted to objects of definite shape, the objects being of elongated shape, e.g. fishing rods, golf clubs.

The present disclosure relates more particularly to a wheeled caddy and mounting system for transport and storage of skis.

BACKGROUND

Hand carts for carrying ski and snowboard equipment are known the art. These purport to carry snowboards, skis and ski equipment, such as poles and boots, on wheeled caddies. Some may use locking devices that secure skis to racks to prevent theft, and some further may be locked to ski-facility structures.

Methods and apparatuses for folding a wheeled apparatus for sports equipment are known in the art; they include various linkage and hinged mechanisms and motions, including sliding, pivoting, nesting and the like.

SUMMARY

An apparatus for transport, storage and lifting of sporting equipment consists of a wheeled caddy, two mounting apparatuses and a bracket. The system is for transporting, storing and locking sporting equipment such as skis. It is designed to carry snowboards, skis, poles, boots and other sporting equipment, and to easily fold and mount to the hitch of a vehicle for transport, or to a wall for storage.

The wheeled caddy enables transport from storage to car to ski area and back. The wheeled caddy comprises a lower frame structure connected by hinges to an upper frame structure. In some embodiments, the caddy's upper frame structure has a handle with a lever that controls a hinge, about which the upper frame structure may be folded downward, effectively compacting the apparatus to about half its height.

In at least one embodiment, the lower frame structure has a bucket for holding the ends of the skis upright against the caddy, and transverse members near the bucket for holding the skis against the frame. Flexing locking bars at the upper end of the lower frame structure can be pivoted into place to lock variously sized skis to the caddy. In one embodiment, cleats at the bottom of the caddy prevent the apparatus from sliding over ice and packed snow. In some embodiments, flexing locking bars at the upper end of the lower frame structure have locking latches that lock the locking bars shut. In other embodiments, a lock cable, stored inside of the lower frame structure, enables locking of the apparatus to a permanent structure. A storage bag holds other ski equipment and may be mounted on the rear of the lower frame structure.

The caddy has two types of mount: one for attaching to a vehicle and another for attaching to a wall. The vehicle mount is configured for mounting the caddy to a vehicle's trailer hitch. In one embodiment the trailer-hitch mechanism has a horizontal structure that fits into a standard trailer hitch on a vehicle. A parallelogram four-bar linkage structure has paired pivoting arms that join mating fixtures. A first fixture is a bracket that acts as a connecting rod that is affixed to the horizontal structure; a second fixture is a second bracket that acts as a connecting rod, each of which is configured to support the caddy when folded and filled with skis. A lever moves a parallelogram four-bar linkage from a lower position to a raised position. The folded caddy may be placed in the second fixture when the apparatus is in the lower position. A latch communicates with a mating receptacle that holds fast the handle of the caddy. The lever is then moved to raise the caddy to the raised position so that it is off the ground and supported by the trailer hitch for transport. The process is reversed to remove the caddy from the vehicle.

A similar apparatus is configured to mount to a wall so that the caddy may be moved from a vehicle to a wall mounted apparatus for storage. One skilled in the art understands that a similar mechanism having a parallelogram four-bar linkage, fixtures and a lever may be used to raise the folded caddy full of skis off the ground to mount on a wall.

In an iteration of the embodiment, a trailer-hitch mechanism is a substantially vertical shaft with connectors at each end. The lower-end connector employs an arm and locking pin for attaching to a vehicle's trailer hitch, and a latch that communicates with a mating receptacle disposed on the handle of the caddy. In use, one wheels the caddy to the vehicle; folds down the caddy's upper frame structure partway; and latches the handle-latch to the mating receptacle on the lower end of the trailer-hitch mechanism. Then the partially folded caddy may be lifted, allowing the caddy to pivot on central hinges while being conducted toward the vehicle mount. There it may be latched in place via a latch on the vehicle that connects to a catch on the caddy. To remove it from the vehicle, it can be unlatched and allowed to pivot on its linkage toward the ground by gravity.

In this iteration, a storage-wall-mounting device works the same way. The upper frame structure's handle is inserted into a receptacle and pivoted about its central hinges such that a catch meets a latch in the wall-mount's upper fixture where it can then be held fast with locking levers.

Further, in this iteration a stationery bracket is used for holding the wall mounting device in storage.

In yet another embodiment, the apparatus may be locked into a partially folded configuration that provides a stand for holding and securing skis to the apparatus in an upright position. The partially folded configuration places frame members on the ground in such a manner as to render the wheels inoperable. Rendering wheels inoperable hinders theft by making it necessary to carry the entire apparatus rather than rolling it on wheels. In addition, a cable lock stored inside the frame of the apparatus locks the folded apparatus to a stationary object.

DESCRIPTION

Figure 1:
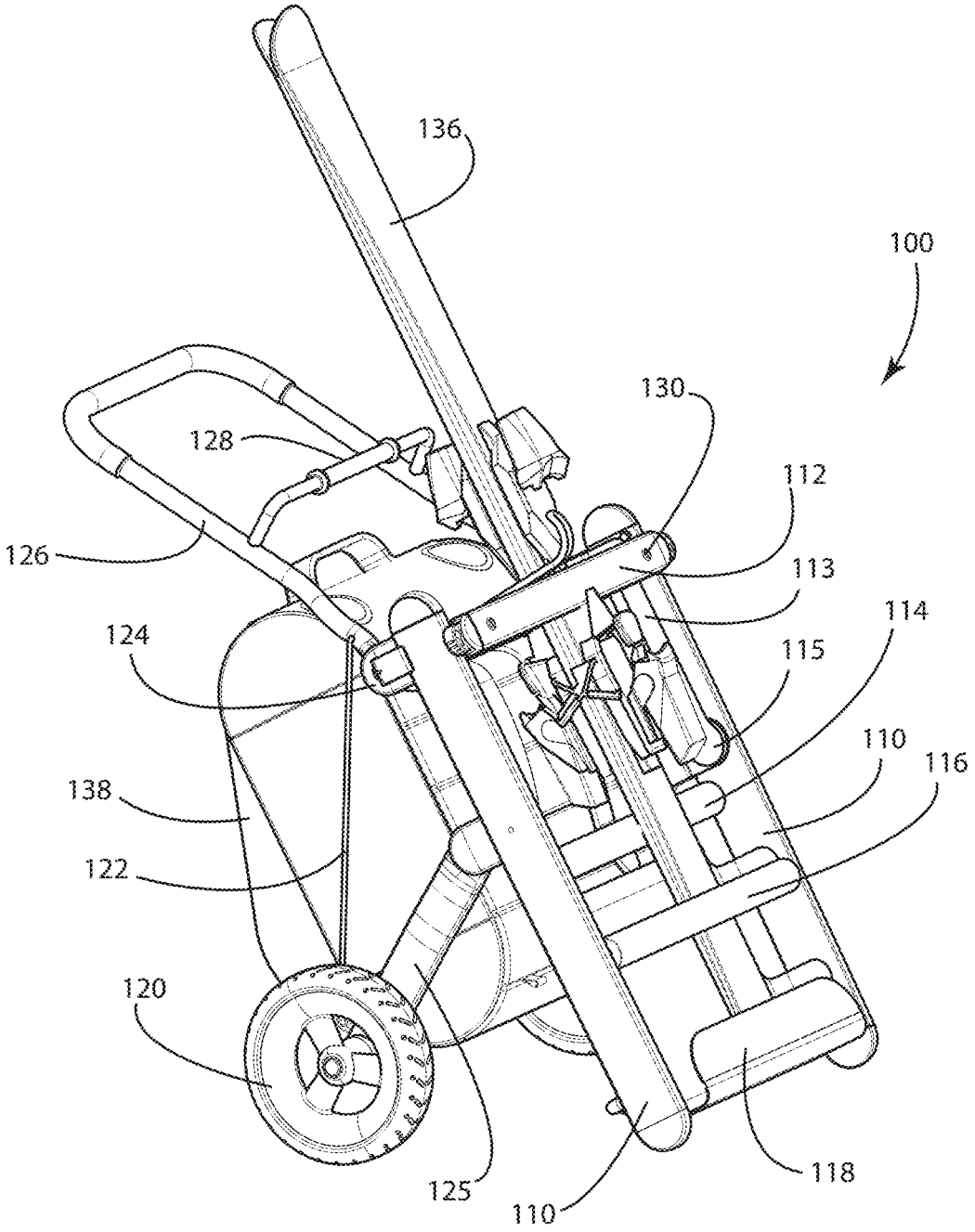
FIG. 1 is a front perspective view of an example embodiment.
Figure 2:
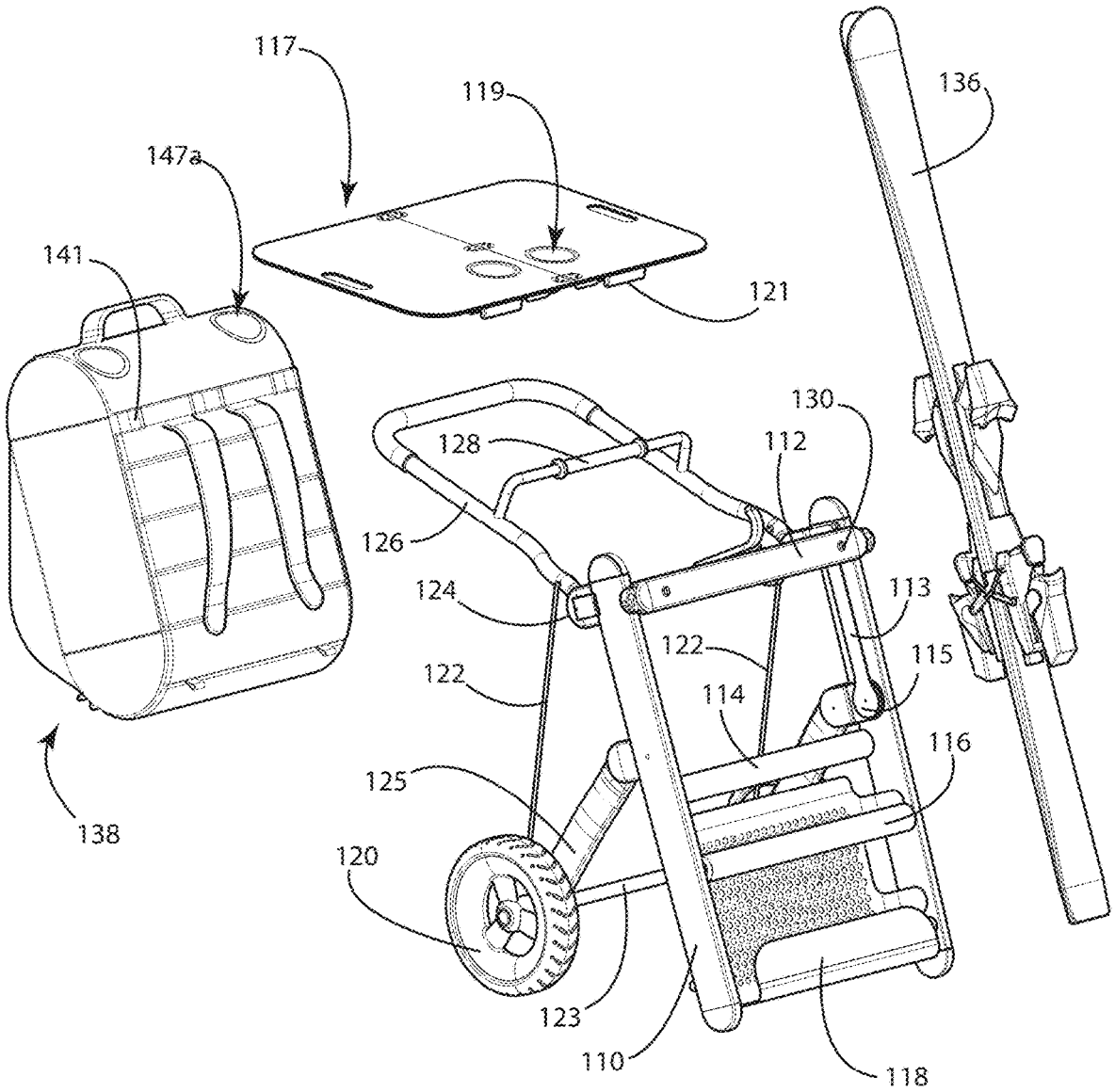
FIG. 2 is a front, partially exploded view thereof.
Figure 3:
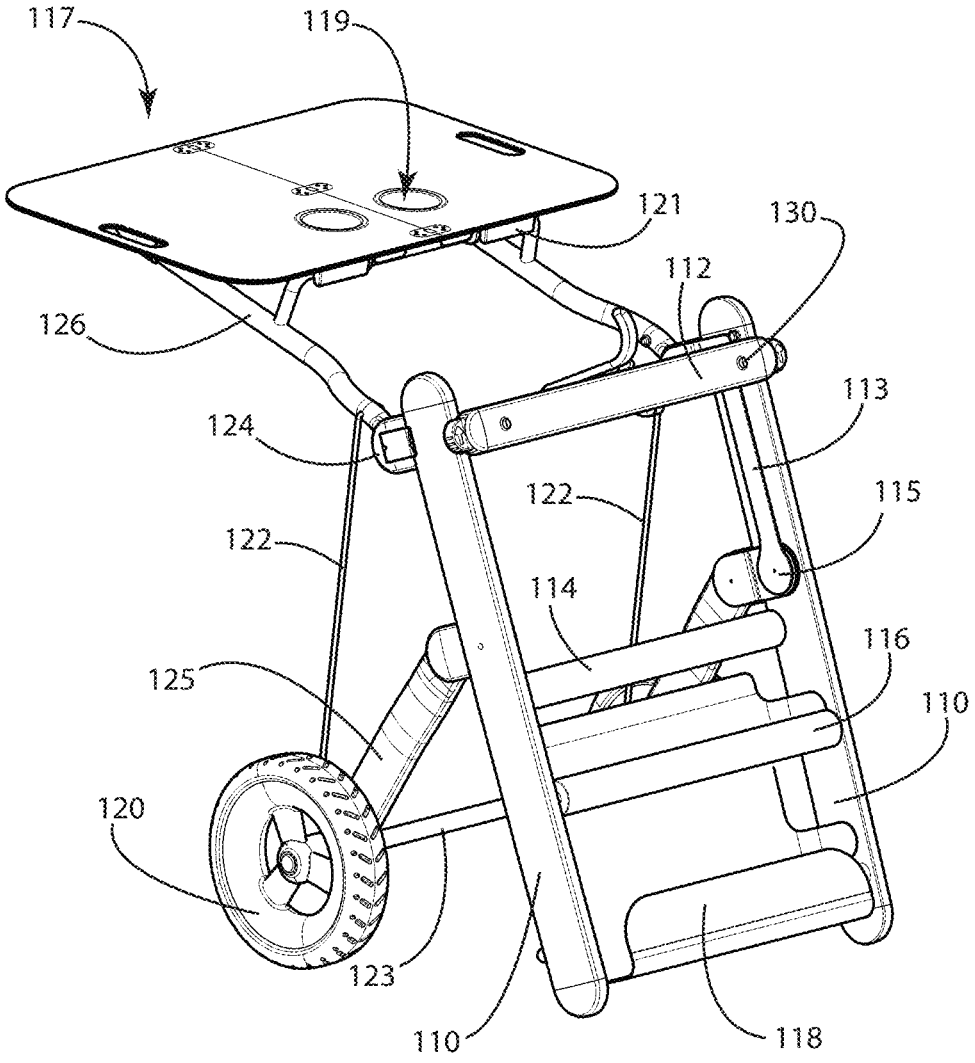
FIG. 3 is a front perspective view of a caddy with a table, thereof.

FIGS. 1-5 show an example embodiment 100. A caddy 100 consists of a lower frame structure 110 connected by a hinge 124 to an upper frame structure 126. The apparatus is moved by wheels 120. Linkage arms 122, 125 comprise the folding mechanism and structural support for wheels 120. In some embodiments, linkage arms 125 are referred to as primary linkage arms, while linkage arms 122 are referred to as secondary linkage arms. The secondary linkage arms 122 serve to connect the wheel axle to the upper frame structure 126 so that the wheels lift when the upper frame structure is pivoted downward as the apparatus is folded. One skilled in the art understands how the linkage enables wheels 120 to collapse against lower frame structure 110 while the upper frame structure 126 pivots about hinge members 124 to fold down against the lower frame structure 110. The lower frame structure supports a receptacle 118 configured to receive an end of one or more skis 136, snowboards or other riding and sliding apparatuses (hereafter referred to as skis). Transverse members 116 and 114 are configured to hold the skis 136 in place on the embodiment. A locking bar 112 is connected by a linkage 113 to the lower frame structure 110 and pivots about point 115 to close against a mating locking bar 111 (FIG. 5) and may be further locked closed with locks 130. One skilled in the art understands how such a structure may be opened to remove skis and closed and locked to safeguard skis from theft when stored in a public area. Locking bars 111 and 112 may include flexible material (e.g., castable elastomer) to form around various sizes and shapes of skis.

Figure 6:
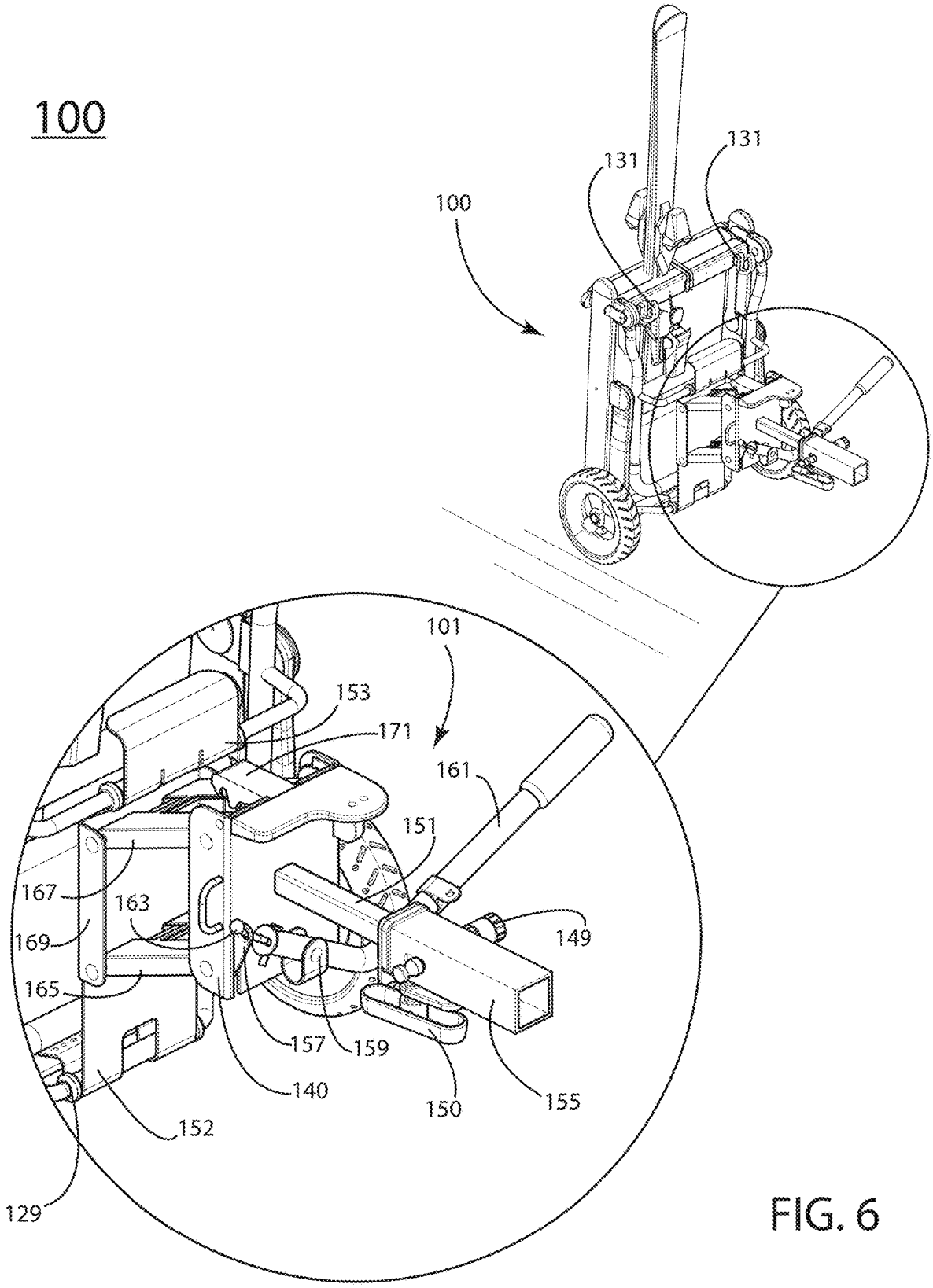
FIG. 6 is a detail perspective view showing the caddy and mounting apparatus for mounting to a trailer hitch, the caddy in a lower position.
Figure 7:
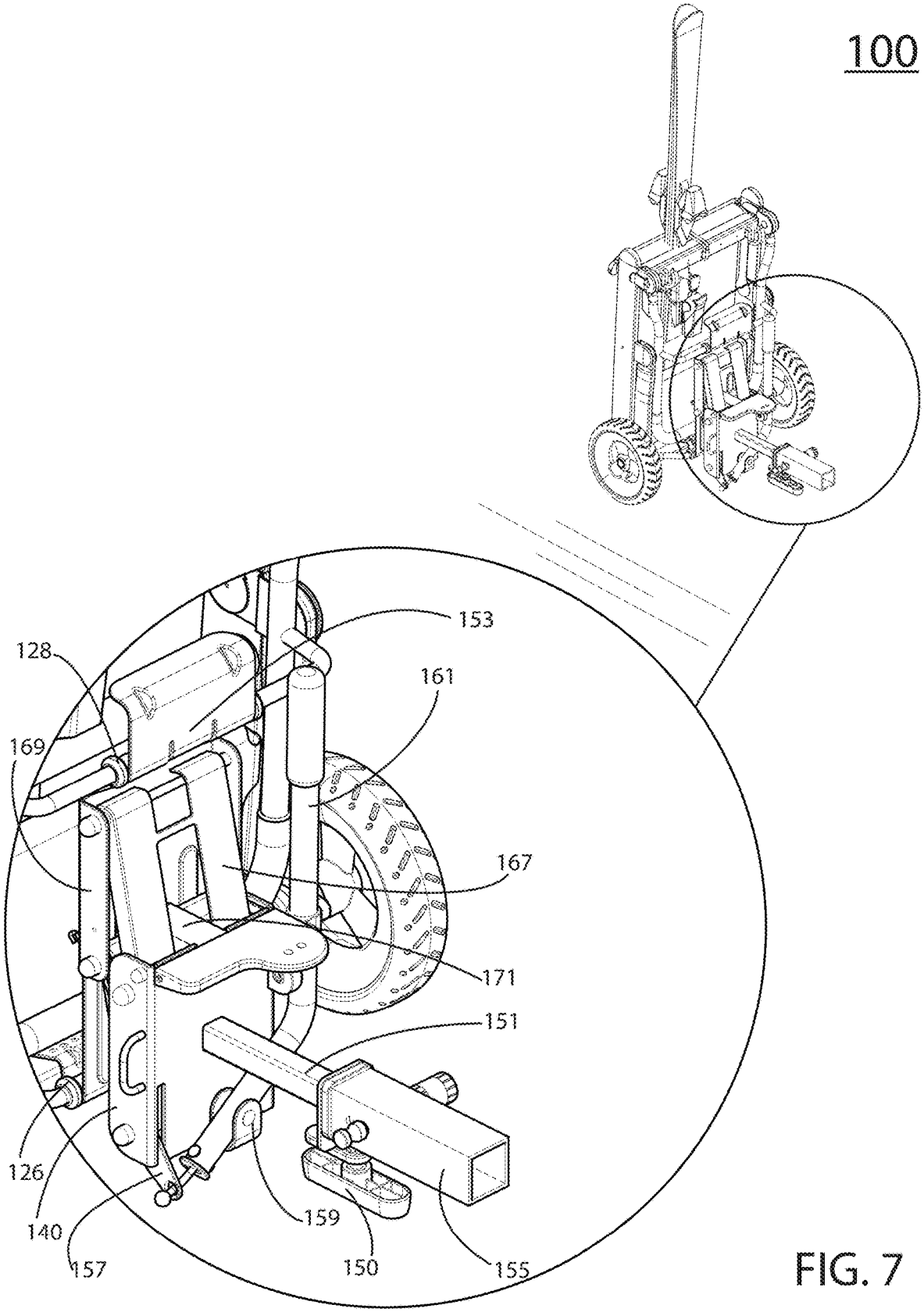
FIG. 7 is a detail perspective view showing the caddy and mounting apparatus for mounting to a trailer hitch, the caddy in a raised position.
Figure 8:
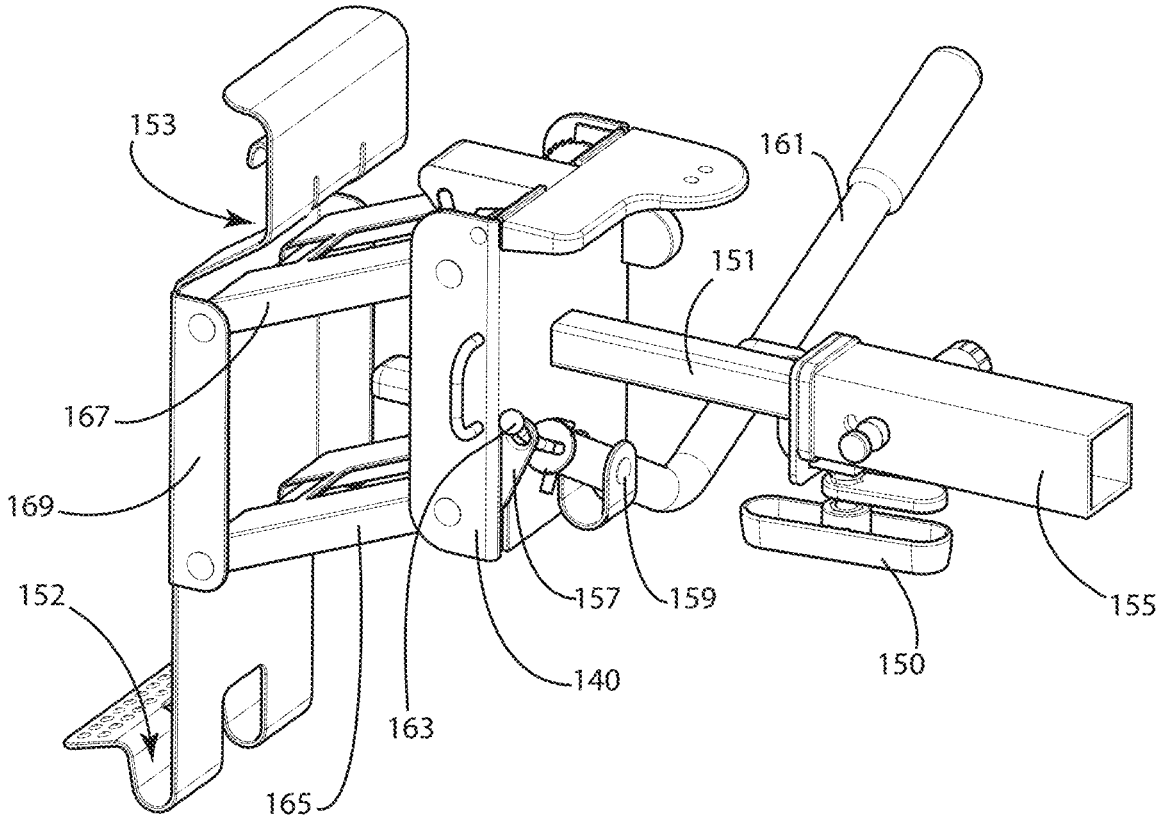
FIG. 8 is a perspective view of the apparatus for mounting the caddy on a trailer hitch in the lower position.

A bag 138 for holding ski boots and other gear has loops 141 that are configured to mate with hooks 131 (FIGS. 5, 6) to affix the bag to the caddy 100.

Upper cross bar 128 and lower cross bar 129 are configured to mount the caddy 100 to an apparatus 101 (FIG. 6) for mounting the caddy to a trailer hitch. The upper cross bar 128 further supports a table 117. The table 117 has cup holders 119 and hardware 121 that is configured to affix the table to the upper cross bar 128 so that it may rest on the upper frame structure 126. One skilled in the art is familiar with pivoting and locking mechanisms such as hinge members 124 that may be moved and locked into the appropriate angle for supporting a table 117 in a horizontal position.

Figure 9:
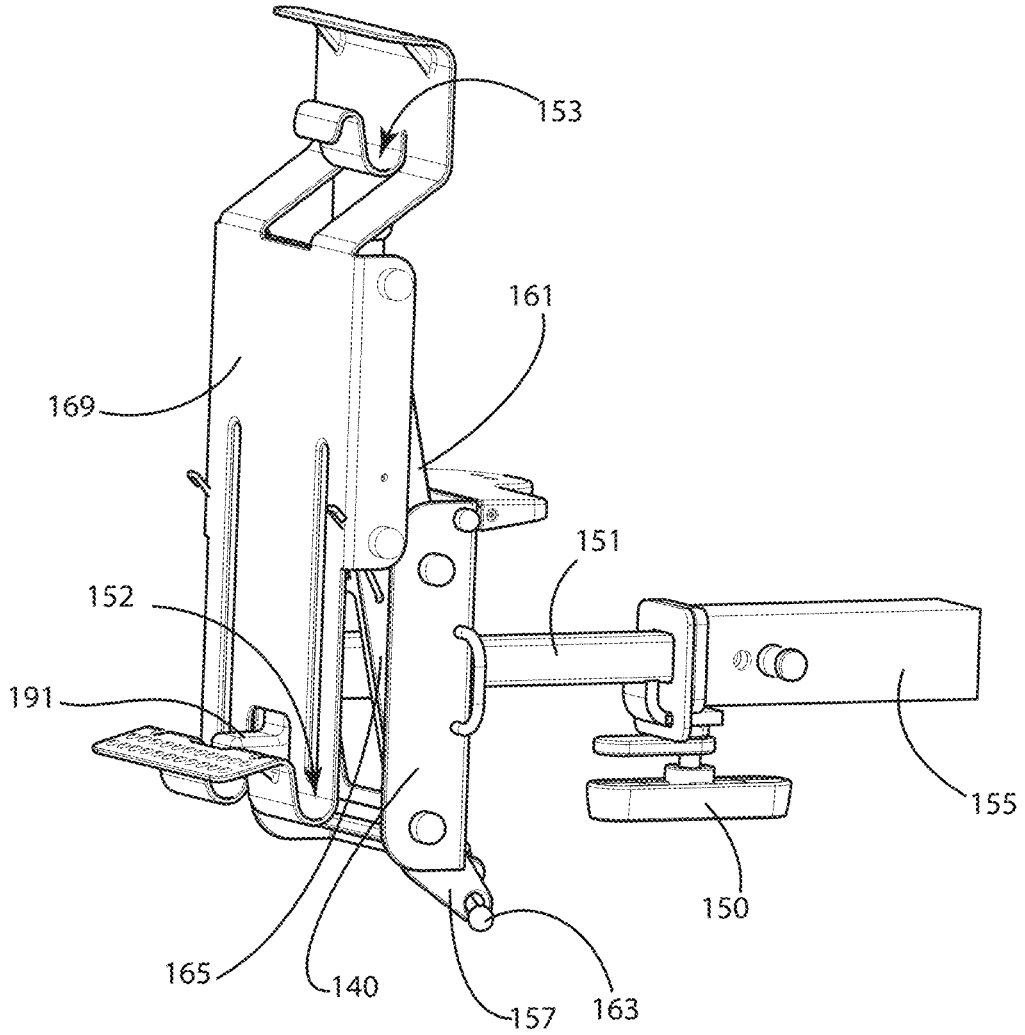
FIG. 9 is a perspective view of the apparatus for mounting the caddy on a trailer hitch in the raised position.

Referring to FIG. 6-FIG. 9, the illustration depicts an apparatus 101 for mounting the caddy 100 to a trailer hitch 155. A horizontal structure 151 mounts to the trailer hitch 155 and is held fast by a fastening pin 149 and adjustment bolt 150. A parallelogram four-bar linkage is comprised of a first fixture 140 and a second fixture 169 joined by a lower parallel linkage 165 and an upper parallel linkage 167. One skilled in the art understands how a parallel linkage may guide the movement of the second fixture 169 to mate in a raised position against the first fixture 140. A lever 161 has a pivot ball joint 163 in a socket 157 that is in turn joined to lower parallel linkage 165. The lever pivots at pivot point 159. One skilled in the art understands how the lever pivots at pivot point 159 to move the parallel linkage members 165/167 to lift the second fixture 169 to a raised position as shown in FIG. 9. The second fixture 169 has a receptacle 153 for receiving upper cross bar 128 and a second receptacle 152 for receiving the lower cross bar 129. A catch 191 is configured to hold the lower cross bar 129 fast in receptacle 152.

Figure 10:
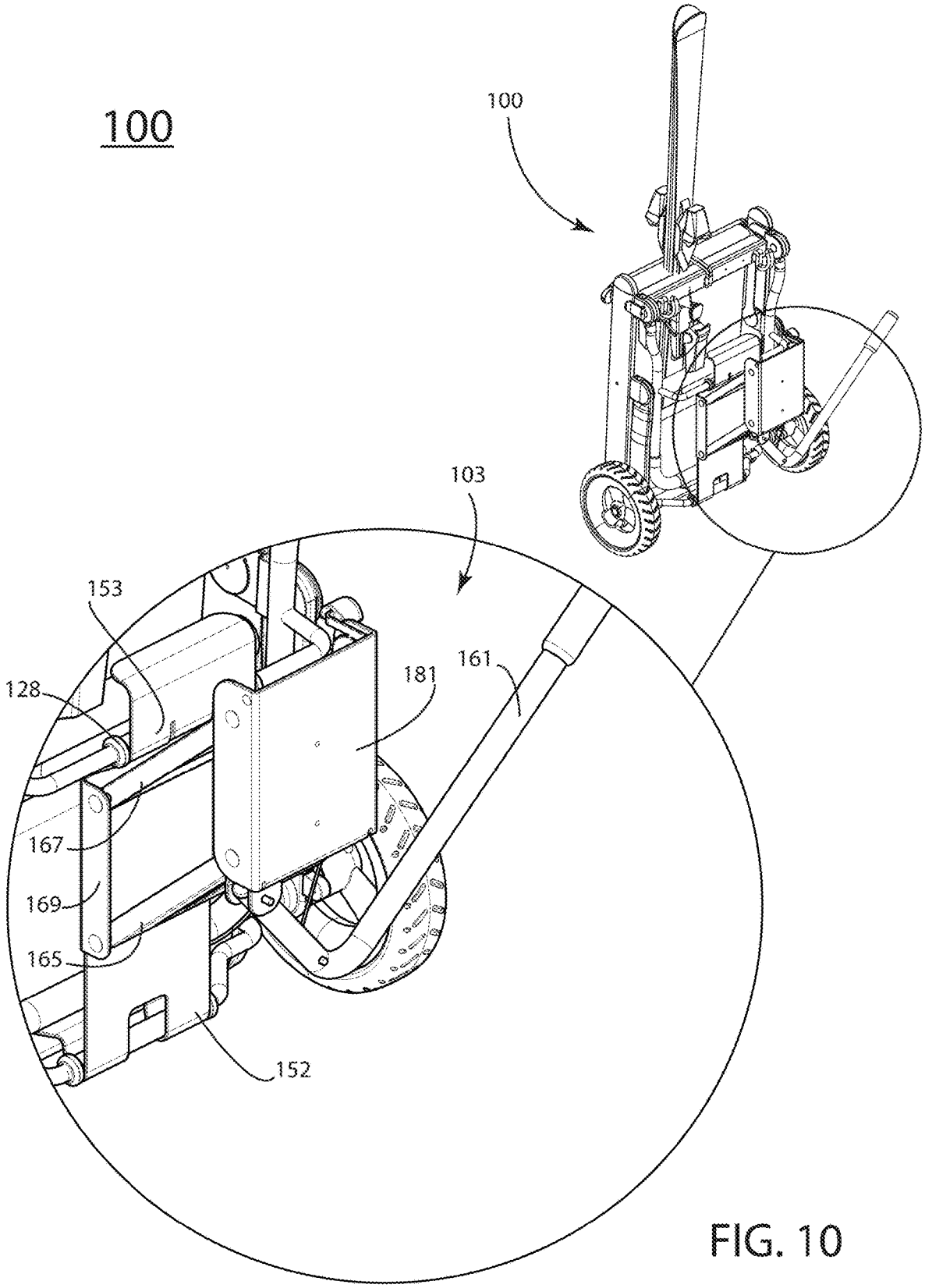
FIG. 10 is a detail perspective view showing the caddy and mounting apparatus for mounting to a wall, the caddy in a lower position.
Figure 11:
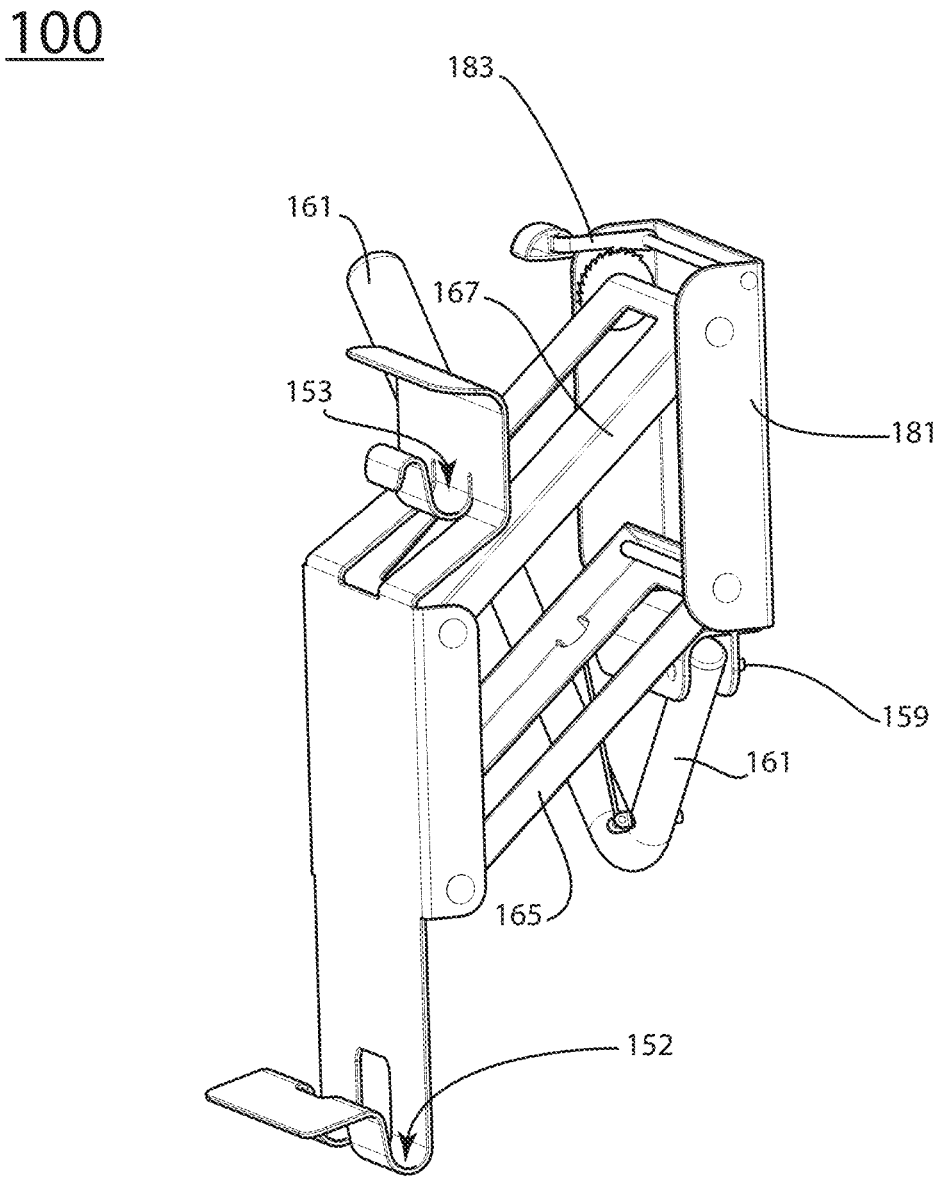
FIG. 11 is a perspective view of the apparatus for mounting the caddy on a wall in the lower position.
Figure 12:
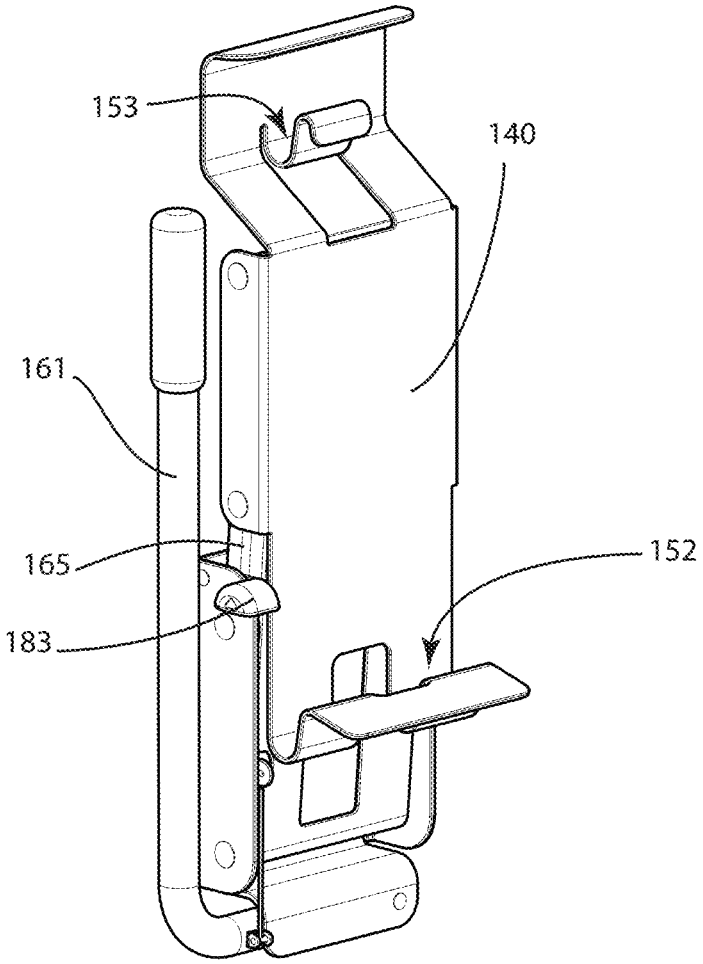
FIG. 12 is a perspective view of the apparatus for mounting the caddy on a wall in the raised position.

Referring to FIGS. 10-12, a wall-mounting apparatus 103 has a first fixture 181 which functions in a similar manner to the first fixture 140. The parallelogram four-bar linkage is similarly composed of a first fixture 181 and a second fixture 169 joined by a lower parallel linkage 165 and an upper parallel linkage 167. The parallel linkage may guide the movement of the second fixture 169 to mate in a raised position against first fixture 181. A lever 161 works with linkage arms 173 to move lower parallel linkage 165. The lever pivots at pivot point 159. One skilled in the art understands how the lever pivots at pivot point 159 to move the parallel linkage members 165 and 167 to lift the second fixture 169 to a raised position as shown in FIG. 12. The second fixture 169 has a receptacle 153 for receiving upper cross bar 128 and a second receptacle 152 for receiving the lower cross bar 129. A ratcheting gear mechanism 183 assists in raising the apparatus. One skilled in the art is familiar with ratcheting gear mechanisms such as mechanism 183 that prevents movement in a downward motion while lifting the apparatus and allows the apparatus to lower when lifting the lever to release the ratcheting gear.

Figure 13:
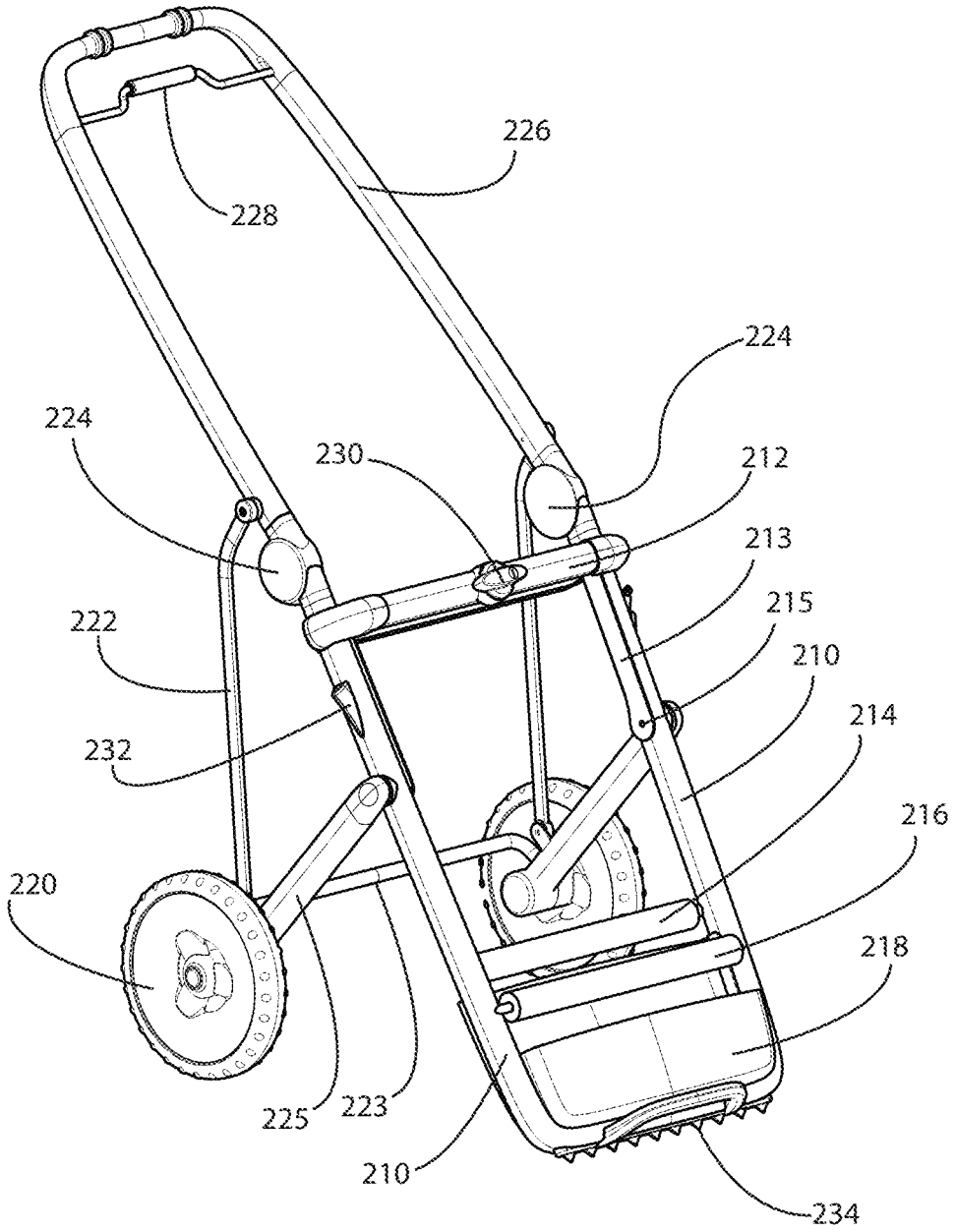
FIG. 13 is a front perspective view of an example embodiment.
Figure 14:
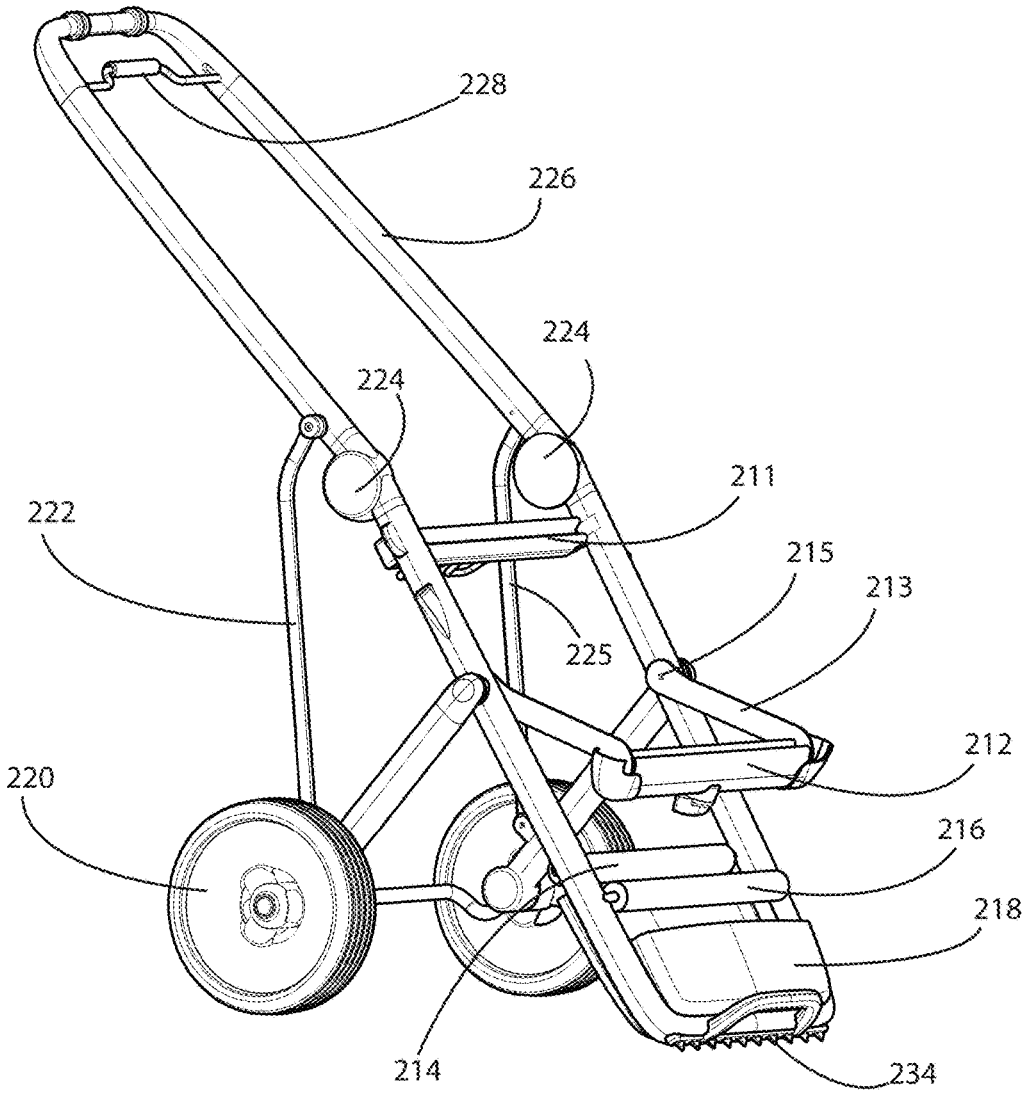
FIG. 14 is another front, perspective view of the same example embodiment.
Figure 15:
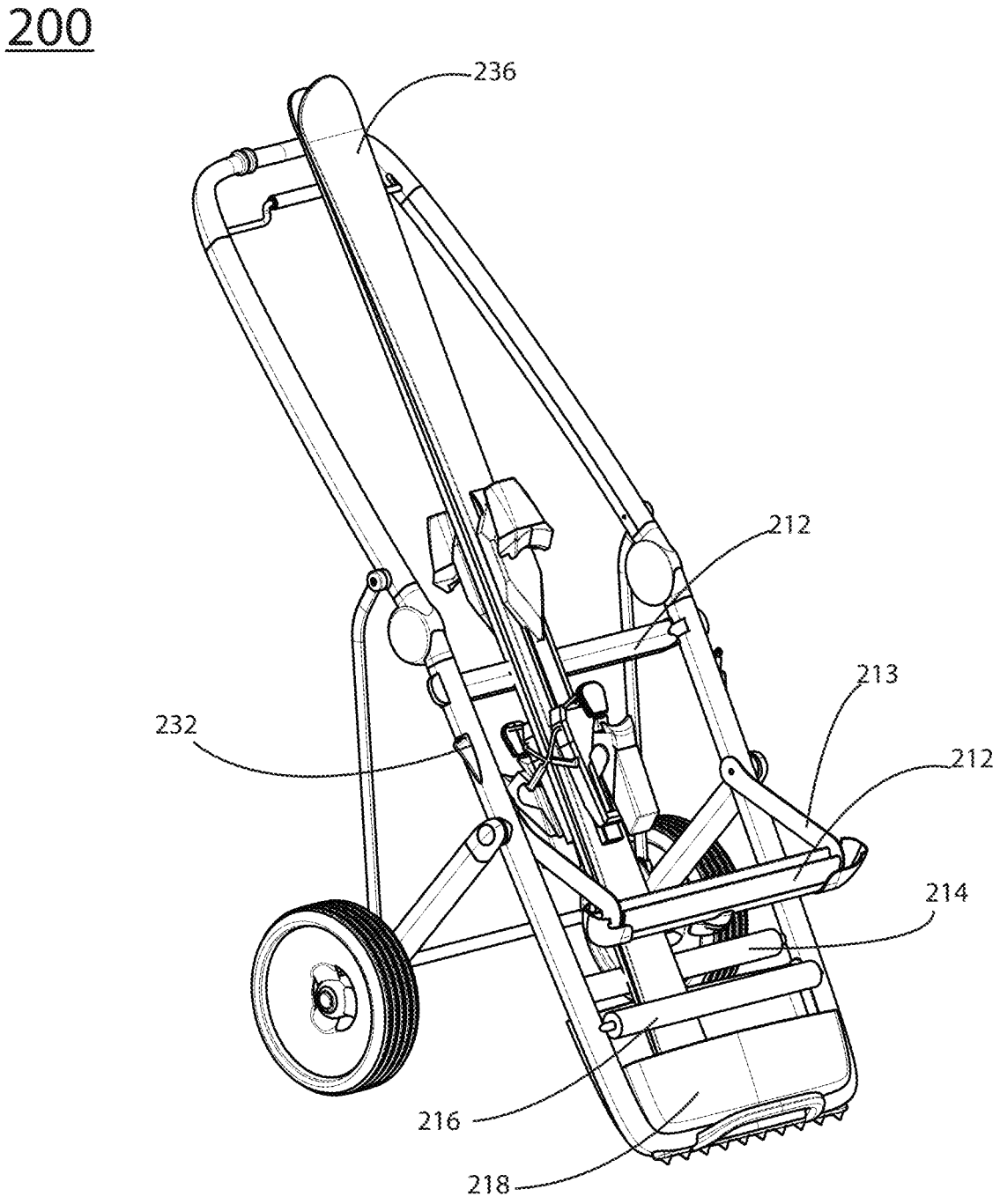
FIG. 15 is a front perspective view shown holding a pair of skis.
Figure 16:
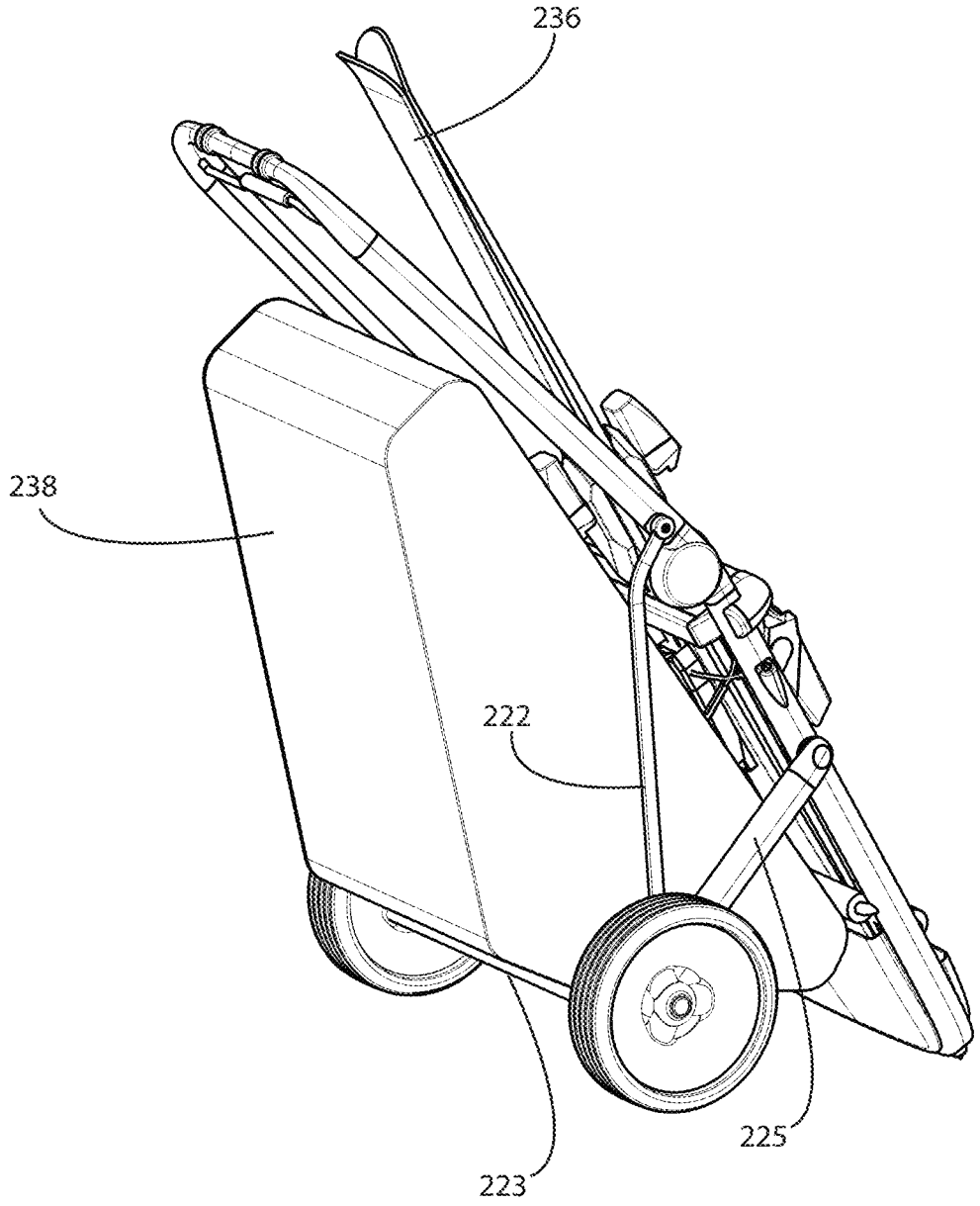
FIG. 16 is a rear perspective view with a storage bag and a pair of skis.

FIGS. 13, 14 and 15 show an example embodiment 200. A caddy 200 consists of lower frame structure 210 connected by a hinge 224 to an upper frame structure 226. A suspension bar 223 gives lateral support between wheels 220. Linkage arms 222, 225 comprise the folding mechanism. One skilled in the art understands how the linkage enables wheels 220 to fold against lower frame structure 210 while the upper frame structure 226 pivots about hinge members 224 to fold against the lower frame structure 210.

The lower frame structure supports a receptacle 218 configured to receive an end of one or more skis 236, snowboards or other riding and sliding apparatuses (hereafter referred to as skis). Transverse members 216 and 214 are configured to hold the skis 236 in place. A locking bar 212 is connected by a linkage 213 to the lower frame structure 210 and pivots about point 215 to close against a mating locking bar 211 (FIG. 2) and may be further locked closed with locking lever 230. One skilled in the art understands how such a structure may be opened to remove skis and closed and locked safeguard skis from theft when stored in a public area. Locking bars 211 and 212 may be constructed of flexible material (e.g., castable elastomer) to form around various sizes and shapes of skis. A lock cable 232 is stored in the lower frame structure 210. One may lock the apparatus 200 to a permanent structure and secure skis with locking bar 212 and locking lever 230. Cleats 234 prevent the apparatus from sliding over ice and packed snow. A linkage inside the upper frame structure 226 is connected to a lever 228 to engage or release hinge members 224.

Figure 4:
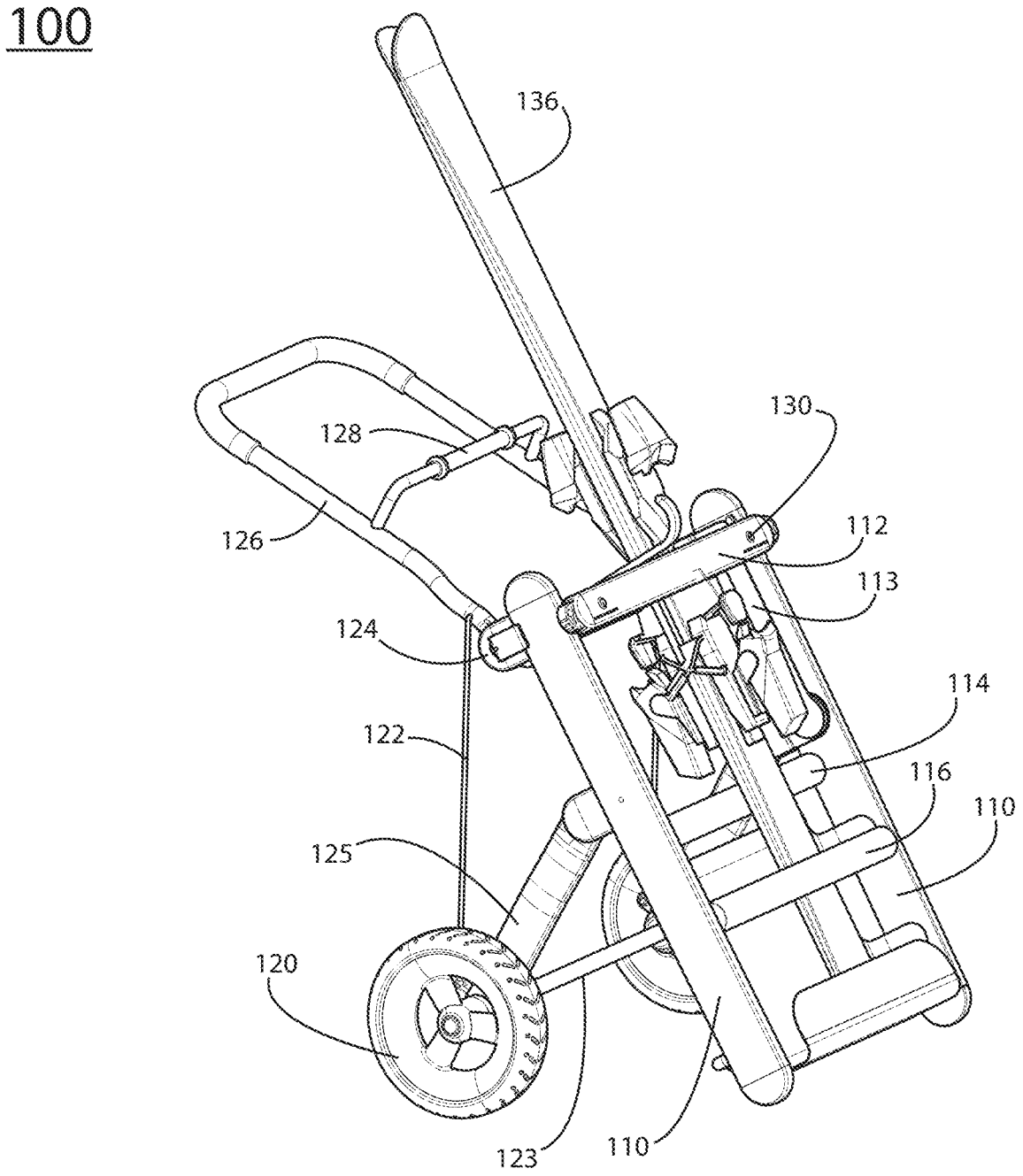
FIG. 4 is a front perspective view of a caddy with a pair of skis, thereof.
Figure 5:
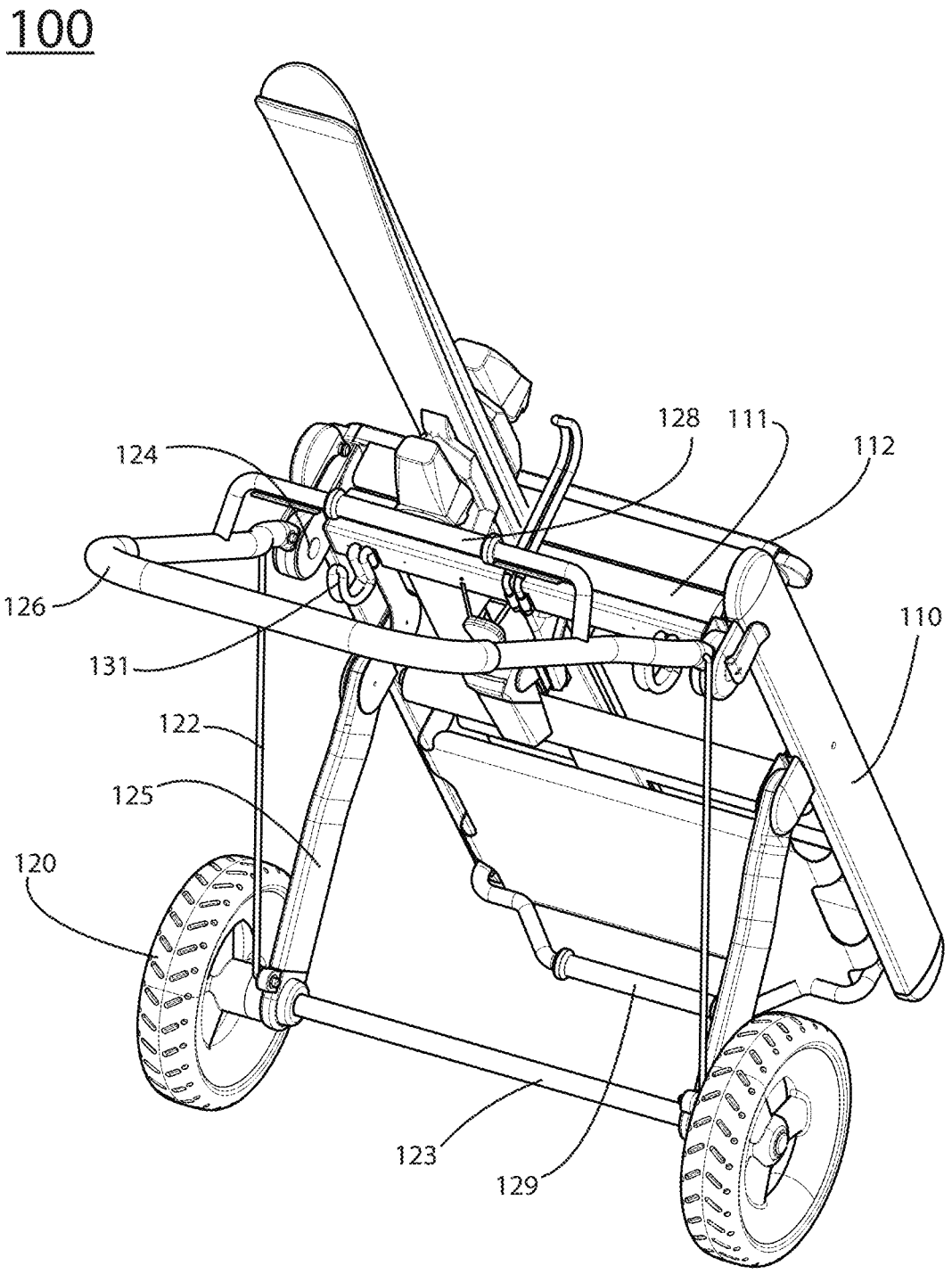
FIG. 5 is a front perspective view of a caddy with a pair of skis, thereof

FIG. 4 shows a rear perspective view of the embodiment 200 with a storage bag 238 mounted in the frame between linkage members 222, 225 and suspension bar 223.

Figure 17:
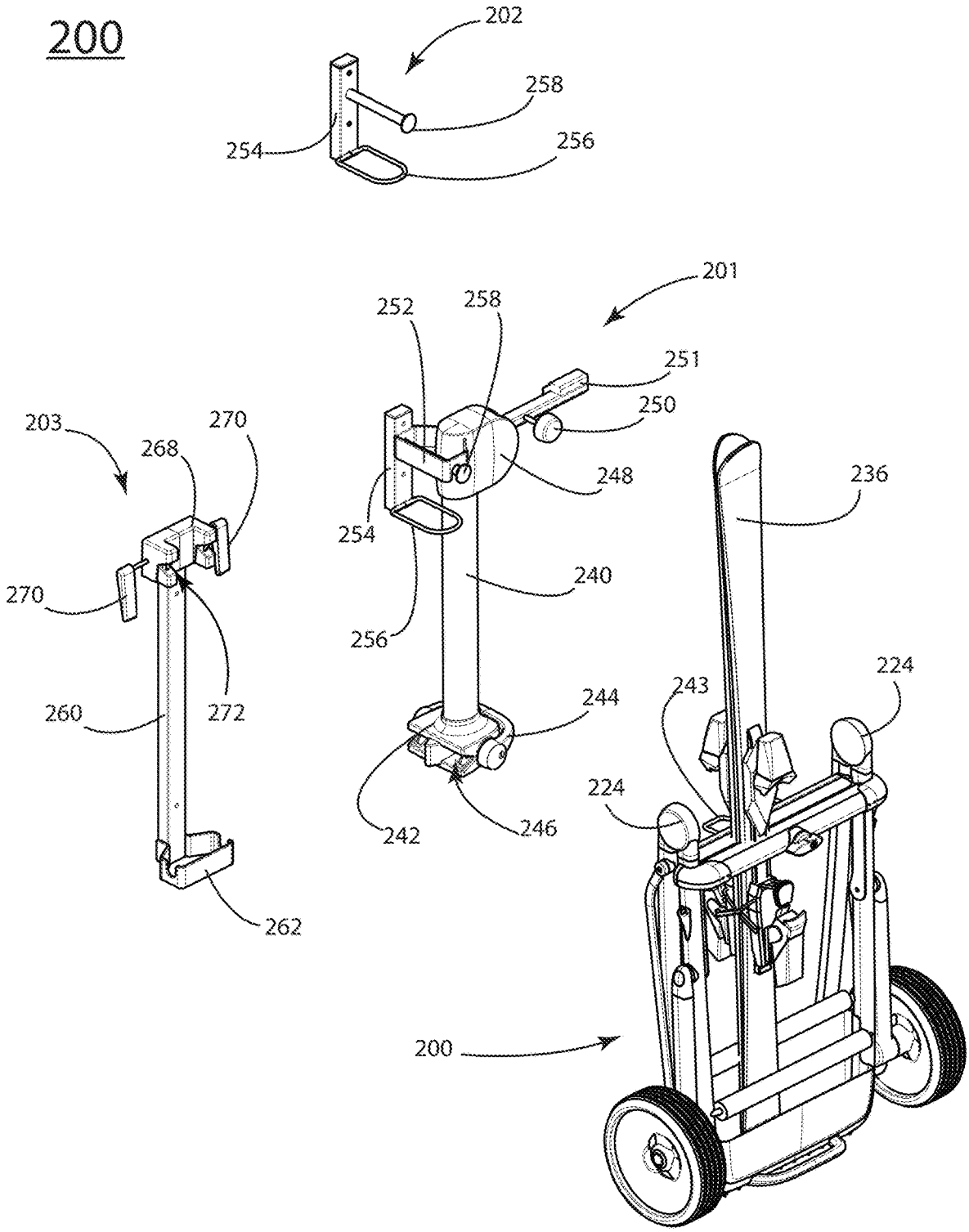
FIG. 17 is a perspective, view of the assembly of the components of the embodiment.
Figure 18:
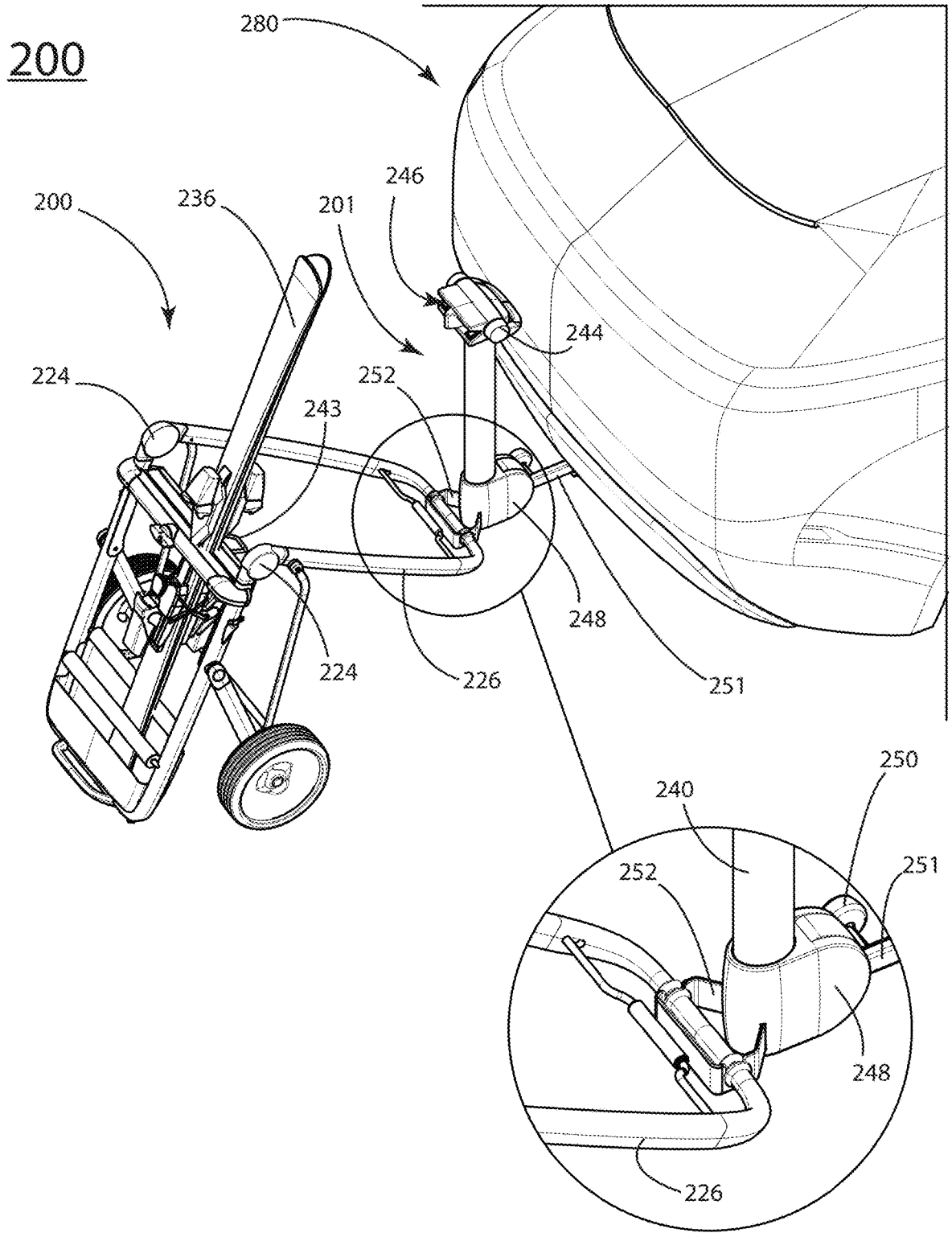
FIG. 18 is a perspective view thereof, in relation to a car.

Referring to FIGS. 17 and 18: FIG. 17 is a perspective, view of the embodiment 200 and FIG. 18 is a perspective view of the embodiment 200 shown as it is mounted to a car. In both FIGS. 17 and 18, the apparatus 200 is shown folded and enclosing a pair of skis 236. A trailer-hitch-mounting mechanism 201 is configured to mount the apparatus 200 to a trailer hitch. A wall bracket 202 is configured to hold the trailer-hitch-mounting mechanism 201 to a wall for storage, and a wall mount 203 is configured to mount the apparatus 200 to a wall. The wall bracket 202 can be installed onto a wall with vertical post 254 being affixed by standard fasteners. A pin 258 and a loop 256 extend laterally from the vertical post 254. The trailer-hitch mechanism 201 has a vertical shaft 240 with a joint 248 at one end and a joint 242 at the opposite end. Joint 248 is configured to mount on a given trailer hitch (FIG. 18); arm 251 with locking pin 250 mount to a standard trailer hitch as shown in FIG. 18. A latch 246 in the other joint 242 mates with a catch 243 (FIGS. 17, 18 and 19) on the apparatus 200, and a locking mechanism 244 locks the latch 246 to the catch 243. The wall mount 203 (FIG. 17) has a vertical post 260 that affixes to a wall with standard fasteners. Fixture 268 resides at the top of the wall mount 203 and a receptacle 262 resides at the bottom. The fixture 268 has a latch 272 that mates with catch 243 on the apparatus 200. Levers 270 lock the catch 243 with the latch 272. One skilled in the art understands that the receptacle 262 of the trailer-hitch-mounting mechanism is of similar structure to the receptacle 252 of the wall mount.

Figure 19:
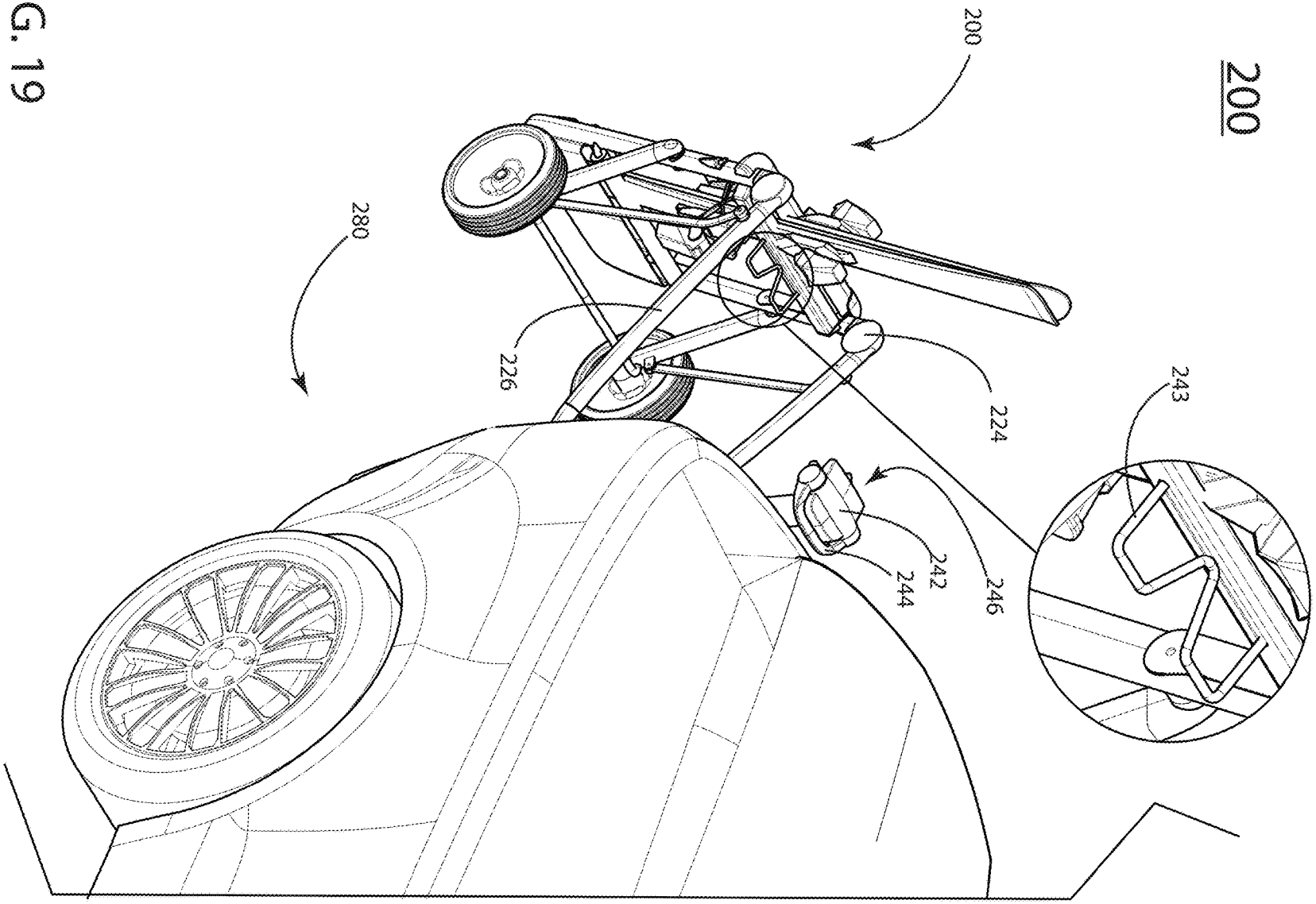
FIG. 19 is a rear perspective view thereof, in relation to a car.

FIGS. 18 and 19 each show a detail view that illustrates the mating of the apparatus 200 with the trailer-hitch-mounting mechanism 201 which is in turn mounted to the trailer hitch of a vehicle 280. The fixture 248 also has a receptacle 252 that receives a portion of the upper frame structure 226. Once the upper frame structure is inserted in the receptacle 252, the loaded apparatus may be pivoted about hinges 224 so that the catch 243 mates with the latch 246 in the fixture 242, and is held fast by locking mechanism 244.

Figure 20:
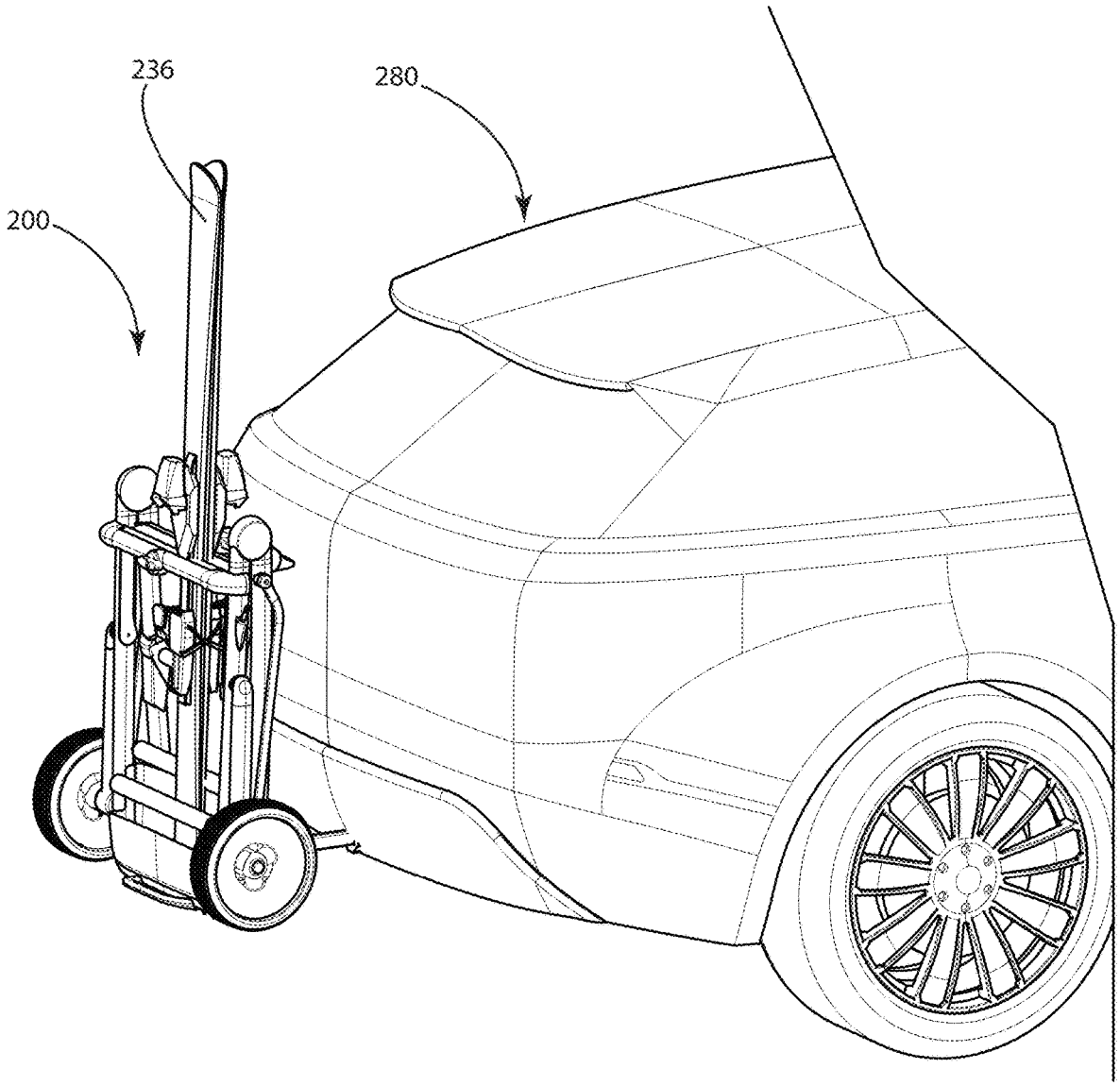
FIG. 20 is a perspective view thereof, showing the embodiment mounted to a car.

FIG. 20 shows the apparatus 200 loaded with skis 236, mounted to a vehicle 280 for transport.

One skilled in the art understands that a user may wheel the apparatus 200 with a number of skis 236 loaded, toward a vehicle 280 and place the upper frame structure 226 in the receptacle 252. It can be seen that a number of skis loaded into the apparatus may be transferred from a ski area to a vehicle and then from a vehicle to a wall mount for storage. Similarly, the apparatus 200 may be mounted in the wall mount 203 (FIG. 17) with upper frame structure 226 (FIG. 19) inserted into the receptacle 262 (FIG. 17) and pivoted about hinges 224 such that the catch 243 meets the latch 272 in fixture 268 where it can then be held fast with locking levers 270. The apparatus 200, still bearing its ski load 236, may be transported from storage to the vehicle and again to the ski area. The example embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the Invention.

Figure 21:
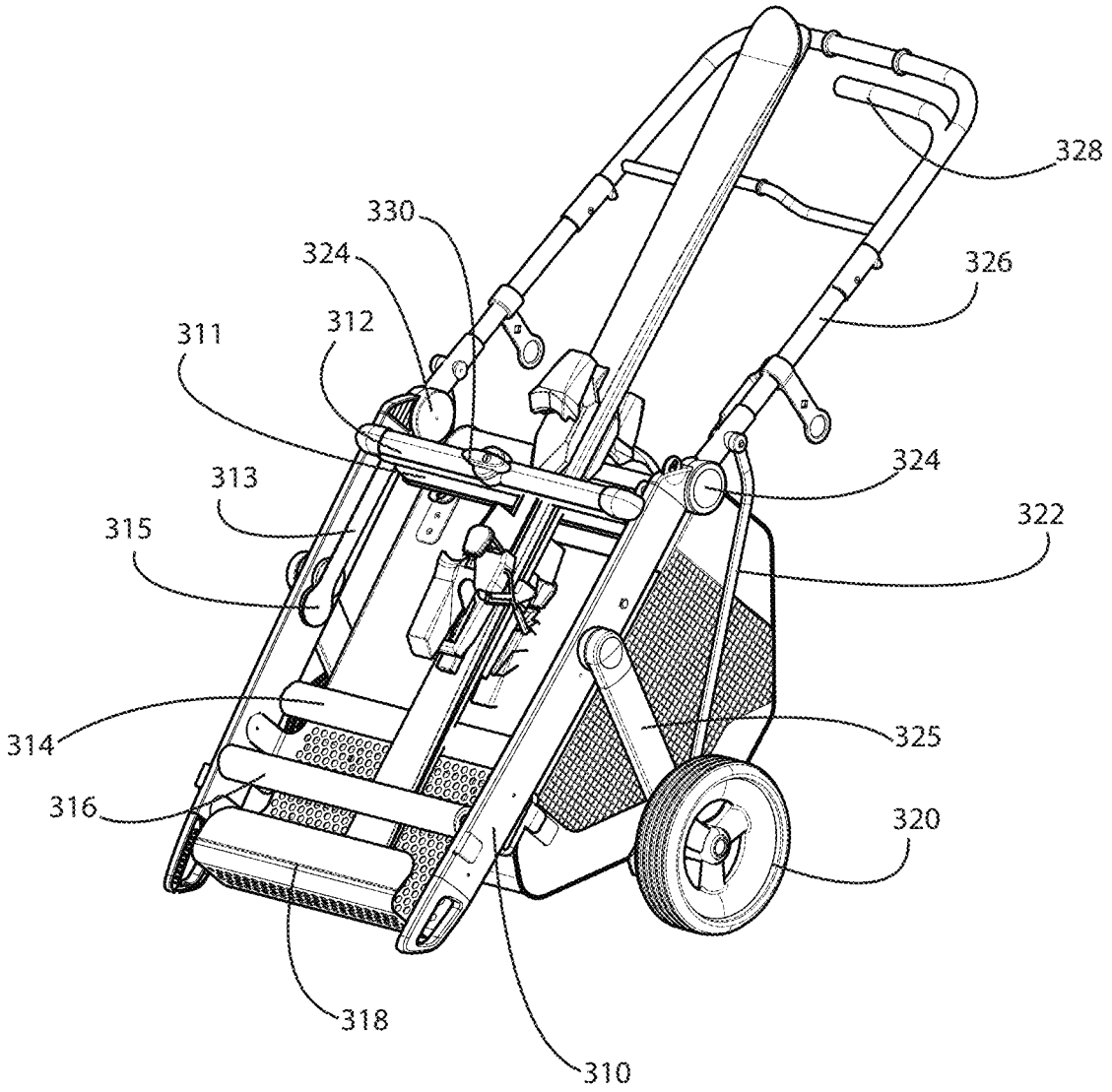
FIG. 21 is a front perspective view of an iteration of the embodiment.
Figure 22:
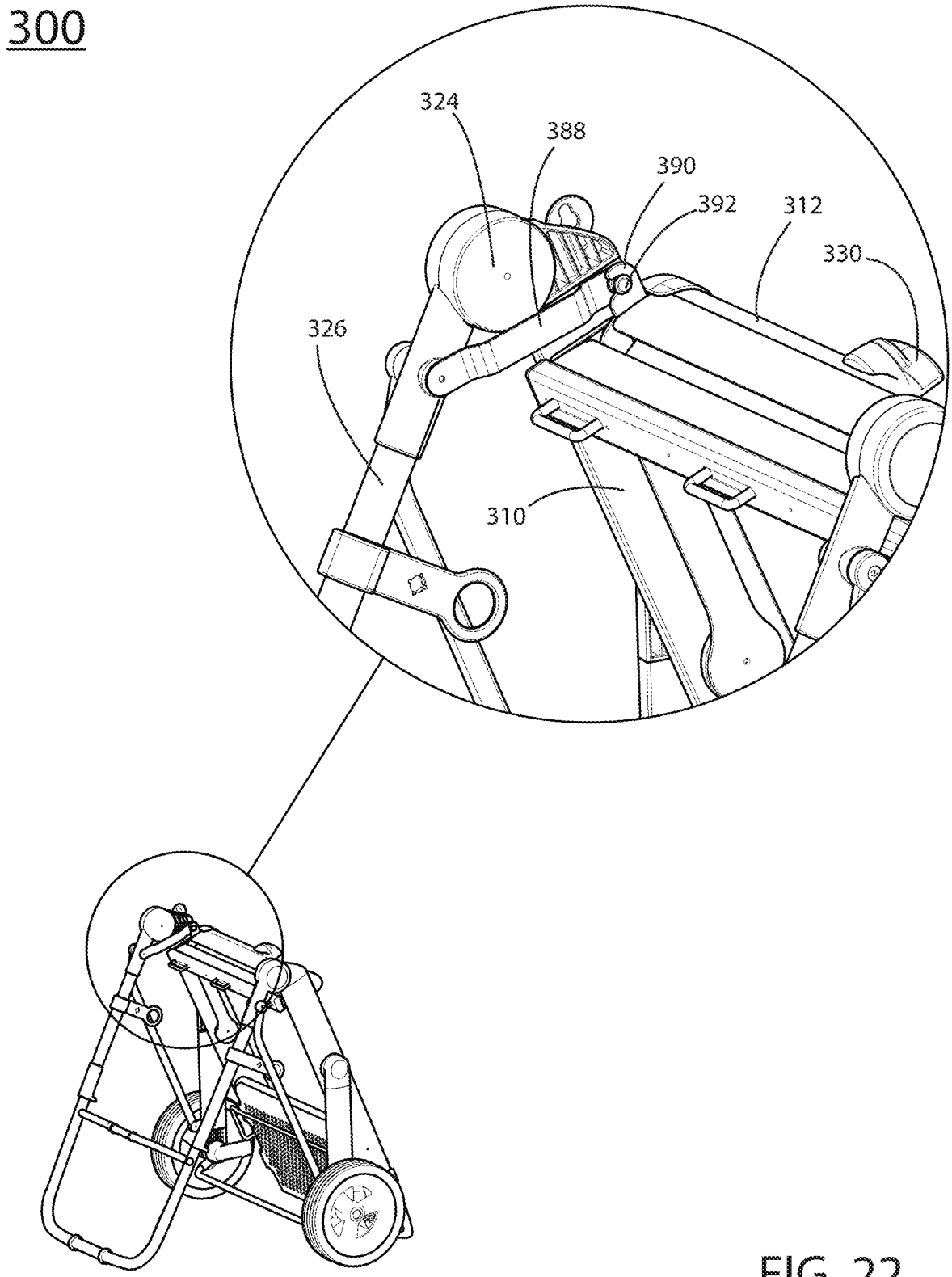
FIG. 22 is a front perspective detail view of the embodiment of FIG. 9.

FIGS. 21 and 22 depict a perspective view and a detail perspective view, respectively, of an example embodiment 300. A caddy 300 consists of lower frame structure 310 connected by a hinge 324 to an upper frame structure 326. The frame structure supports wheels 320. Linkage arms 322, 325 comprise the folding mechanism. One skilled in the art understands how the linkage enables wheels 320 to fold against lower frame structure 310 while the upper frame structure 326 pivots about hinge members 324 to fold against the lower frame structure 310. The lower frame structure supports a receptacle 318 configured to receive an end of one or more skis, snowboards or other riding and sliding apparatuses (hereafter referred to as skis). Transverse members 316 and 314 are configured to hold the skis in place. A locking bar 312 is connected by a linkage 313 to the lower frame structure 310 and pivots about point 315 to close against a mating locking bar 311 and may be further locked closed with lock 330. One skilled in the art understands how such a structure may be opened to remove skis and closed and locked protect skis from theft when stored in a public area. Locking bars 311 and 312 may be constructed of flexible material (e.g., castable elastomer) to form around various sizes and shapes of skis. One may lock the apparatus 300 to a permanent structure and secure skis with locking bar 312 and lock 330.

Figure 23:
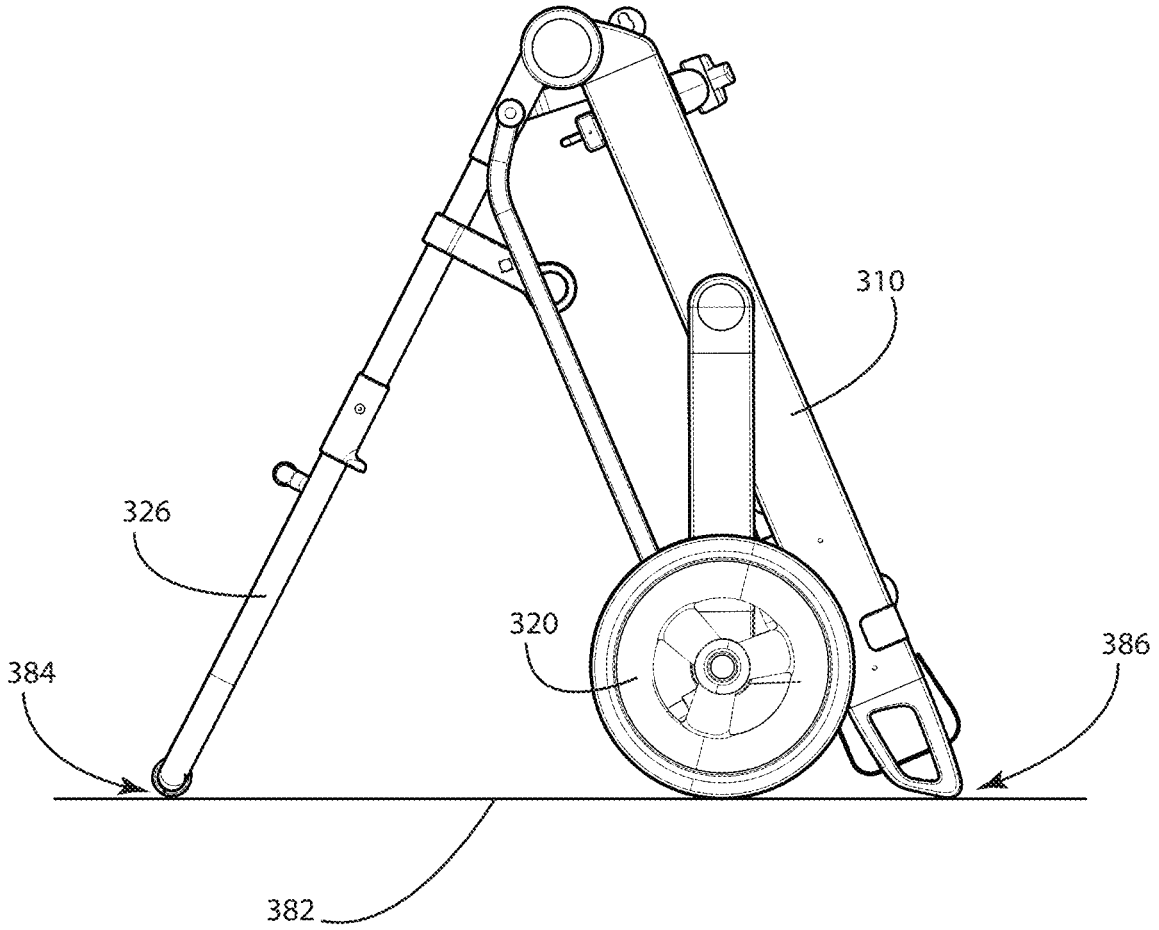
FIG. 23 is a side orthographic view of the embodiment of FIG. 9.

An illustration of the apparatus 300 in a partially folded configuration is depicted in a perspective view in FIG. 22 and in a side view in FIG. 23. The apparatus 300 is folded about hinge members 324 so that the upper frame structure 326 and the lower frame structure 310 touch the ground, represented by line 382 (FIG. 23). The upper frame structure 326 meets the ground at point 384 and the lower frame structure 310 meets the ground 382 at point 386. In this configuration, the wheels 320 are rendered inoperable. One skilled in the art understands that such a configuration makes it difficult to steal an item as it must be carried and cannot be rolled along the ground. A linkage 388 (FIG. 22) locks the apparatus 300 in the partially folded configuration. The linkage 388 is joined to the upper frame structure 326 at a first end and is fitted at a second end over a protrusion 392 which is held fast by a latch 390. The latch 390 is affixed to the locking bar 312 and is rendered immovable when the locking bar 312 is fastened by lock 330. When the linkage 388 is fitted over the protrusion 392 and the latch 390 is closed over the linkage 388, it may be locked into place via locking bar 312 and lock 330. This locks the apparatus 300 into the configuration shown in FIGS. 22 and 23.

Figure 24A:
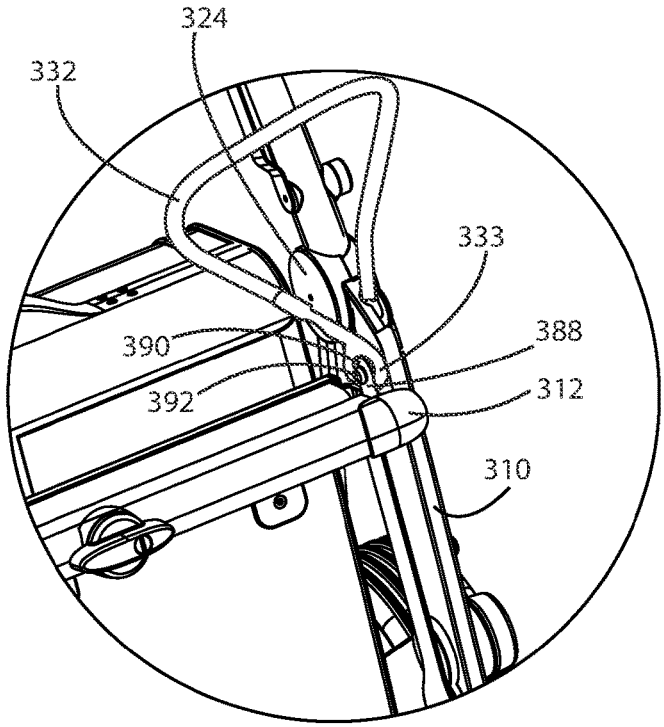
FIG. 24*a* is a detail view depicting the locking mechanism.
Figure 24B:
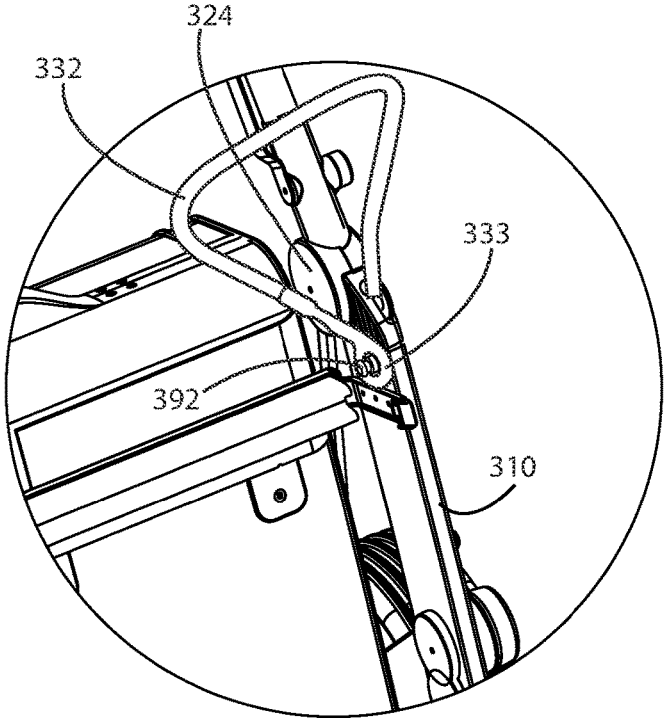
FIG. 24*b* is a detail view depicting the locking mechanism.

Referring to FIG. 24*a* and FIG. 24*b*, detail views of the locking mechanism show a cable lock on the protrusion 392. A cable lock 332 is stored in the lower frame structure 310 and may be looped around a stationary object and the cable end 333 placed over the protrusion 392. With the cable end 333 and the linkage 388, fitted over the protrusion 392 and the latch 390 closed over the linkage 388, the cable as well as the linkage may be locked into place via locking bar 312 and lock 330 (FIG. 24*a*, FIG. 22). The apparatus is thus locked in the configuration shown in FIGS. 22 and 23 while the cable lock 332 holds the apparatus locked to a stationary object.

The invention claimed is:

1. An apparatus for transporting and storing ski equipment comprising:

a lower frame structure; and an upper frame structure pivotally engaged with said lower frame structure; and at least two wheels rotationally engaged with said lower frame structure; and a lower receptacle fixedly engaged with said lower frame structure for receiving at least one end of at least one piece of sporting equipment; and an upper receptacle movably engaged with said lower frame structure for holding said at least one piece of sporting equipment; and at least two primary linkage arms pivotally engaged with said lower frame structure and each of the two primary linkage arms rotationally engaged proximal to at least one of each of said at least two wheels; and at least two secondary linkage arms pivotally engaged with said at least two primary linkage arms and further pivotally engaged with said upper frame structure;

a second apparatus for mounting the apparatus for transporting and storing ski equipment, the second apparatus comprising a first fixture having at least a first receptacle for receiving an upper frame structure and at least one additional receptacle for receiving a lower frame structure; and a second fixture; and an upper parallel linkage pivotally engaged with said first fixture and said second fixture; and a lower parallel linkage pivotally engaged with said first fixture and said second fixture; and said upper parallel linkage and said lower parallel linkage configured to move said first fixture from a first position to a second position; wherein said upper frame structure provides a handle such that the at least one piece of sporting equipment may be wheeled about; and pivoting said upper frame structure with respect to said lower frame structure moves said secondary linkage arms, which in turn move said primary linkage arms, as the apparatus is folded; and in a folded configuration, said upper frame structure and said lower frame structure received in said first receptacle and said second receptacle, respectively, may be moved from said first position to said second position.

2. The apparatus of claim 1 further comprising:

a locking bar removably engaged with said lower frame structure having at least one locking latch; wherein said locking bar may be moved over said at least one piece of sporting equipment, and said at least one locking latch locks said at least one piece of sporting equipment to said lower frame structure.

3. The apparatus of claim 1 further comprising:

at least one fastener configured to affix at least one piece of luggage to said lower frame structure.

4. The apparatus of claim 1 further comprising:

an upper cross bar fixedly engaged with said upper frame structure; wherein the upper cross bar provides rigidity to the upper frame structure.

5. The apparatus of claim 1 further comprising:

a lower cross bar fixedly engaged with said lower frame structure; wherein the lower cross bar provides rigidity to the lower frame structure.

6. The apparatus of claim 4 wherein:

said upper cross bar is configured to support a portable table when said upper cross bar is in a first position, and is configured to removably engage the apparatus on a mounting apparatus when said cross bar is in a second position.

7. The apparatus of claim 4 or claim 5 wherein:

said upper cross bar and said lower cross bar are further configured to mate with a mounting apparatus.

8. The apparatus of claim 4 or claim 5 further comprising:

a mounting apparatus, the mounting apparatus comprising a first receptacle for receiving said upper cross bar and a second receptacle for receiving said lower cross bar; wherein said mounting apparatus is configured to affix to a trailer hitch.

9. The apparatus of claim 4 or claim 5 further comprising;

a mounting apparatus, the mounting apparatus comprising a first receptacle for receiving said upper cross bar and a second receptacle for receiving said lower cross bar; wherein said mounting apparatus is configured to affix to a wall.

10. An apparatus for transporting and storing ski equipment comprising:

a lower frame structure; and an upper frame structure pivotally engaged with said lower frame structure; and at least two wheels rotationally engaged with said lower frame structure; and a lower receptacle fixedly engaged with said lower frame structure for receiving at least one end of at least one piece of sporting equipment; and an upper receptacle movably engaged with said lower frame structure for holding said at least one piece of sporting equipment; and at least two primary linkage arms pivotally engaged with said lower frame structure and each rotationally engaged with one of each of said at least two wheels; and at least two secondary linkage arms pivotally engaged with said at least two primary linkage arms and further pivotally engaged with said upper frame structure;

a locking bar removably engaged with said lower frame structure having at least one locking latch; and an upper cross bar fixedly engaged with said upper frame structure; and a lower cross bar fixedly engaged with said lower frame structure; and a mounting apparatus configured to removably engage said upper frame structure and said lower frame structure; and a first fixture having at least a first receptacle for receiving said upper cross bar and at least a second receptacle for receiving said lower cross bar; and a second fixture; and an upper parallel linkage pivotally engaged with said first fixture and said second fixture; and a lower parallel linkage pivotally engaged with said first fixture and said second fixture; and said upper parallel linkage and said lower parallel linkage configured to move said first fixture from a first position to a second position; wherein said locking bar may be moved over said at least one piece of sporting equipment said at least one locking latch locks said at least one piece of sporting equipment to said lower frame structure; and said upper frame structure provides a handle configured to move said apparatus about on said wheels; and pivoting said upper frame structure with respect to said lower frame structure moves said secondary linkage arms which in turn move said primary linkage arms as the apparatus is folded; and wherein said apparatus in a folded configuration, said upper cross bar and said lower cross bar received in said first receptacle and said second receptacle respectively, may be moved from said first position to said second position a first catch pivotally engaged with said first fixture proximal to said at least second receptacle configured to fasten a lower frame structure; and a second catch pivotally engaged with said second fixture and removably engaged with said first fixture configured to hold fast, said first fixture to said second fixture; wherein the apparatus is held fast while in motion said second fixture having a horizontal structural member configured to removably engage with a trailer hitch.

11. The apparatus of claim 10 further comprising a lower padded bar fixedly engaged at each end with either side of said lower frame structure; and an upper padded bar fixedly engaged at each end with either side of said lower frame structure; wherein said at least one piece of sports equipment may reside behind said lower padded bar and in front of said upper padded bar, holding said at least one piece of sports equipment fast.

12. The apparatus of claim 10 further comprising:

at least one arm fixedly engaged with said locking bar and pivotally engaged with said lower frame structure; wherein said at least one arm keeps said locking bar attached to said lower frame structure when said locking bar is moved to place said at least one piece of sports equipment in said lower frame structure.

13. A method for using the apparatus of claim 10, the method comprising:

placing a portion of said at least one piece of sporting equipment in said lower receptacle; and moving said locking bar thus movably engaging said locking bar with said lower frame structure over said at least one piece of sporting equipment; and wheeling said apparatus with said at least one piece of sporting equipment; and pivoting said upper frame structure with respect to said lower frame structure; and folding said apparatus; and engaging said upper frame structure with said receptacle for receiving said upper frame structure; and engaging said lower frame structure with said receptacle for receiving said lower frame structure; and engaging said first catch; and moving said first fixture about said first parallel linkage and said second parallel linkage; and engaging said second catch; wherein said apparatus is engaged with said mounting apparatus and is lifted when said first fixture is moved proximal to said second fixture and is mounted on a trailer hitch.

* * * * *